US010679460B1

(12) United States Patent
Feola

(10) Patent No.: US 10,679,460 B1
(45) Date of Patent: Jun. 9, 2020

(54) METHOD AND APPARATUS FOR PLAYING A POKER-TYPE KENO GAME

(71) Applicant: New Vision Gaming & Development, Inc., North Reading, MA (US)

(72) Inventor: John Feola, North Reading, MA (US)

(73) Assignee: New Vision Gaming & Development, Inc., Methuen, MA (US)

( * ) Notice: Subject to any disclaimer, the term of this patent is extended or adjusted under 35 U.S.C. 154(b) by 0 days.

(21) Appl. No.: 15/496,177

(22) Filed: Apr. 25, 2017

Related U.S. Application Data

(63) Continuation of application No. 14/281,339, filed on May 19, 2014, now abandoned, which is a continuation-in-part of application No. 14/020,359, filed on Sep. 6, 2013, now abandoned, which is a continuation-in-part of application No. 13/845,157, filed on Mar. 18, 2013, now abandoned.

(51) Int. Cl.
*A63F 9/24* (2006.01)
*G07F 17/32* (2006.01)
*A63F 1/00* (2006.01)

(52) U.S. Cl.
CPC ..... *G07F 17/3239* (2013.01); *G07F 17/3211* (2013.01); *G07F 17/3251* (2013.01); *G07F 17/3267* (2013.01); *G07F 17/3288* (2013.01); *G07F 17/3293* (2013.01); *A63F 2001/001* (2013.01); *A63F 2001/005* (2013.01)

(58) Field of Classification Search
CPC .... A63F 3/0665; A63F 1/00; A63F 2001/008; A63F 3/00157; A63F 2001/005; A63F 2009/2408; A63F 2009/2457; G07F 17/3293; G07F 17/32; G07F 17/3244; G07F 17/329; G07F 17/3267; G07F 17/3239; G07F 17/3286; G07F 17/3262; G07F 17/3225
See application file for complete search history.

(56) References Cited

U.S. PATENT DOCUMENTS

| | | | |
|---|---|---|---|
| 1,527,929 | A | 2/1925 | Simons |
| 1,616,884 | A | 2/1927 | Bosley et al. |
| 4,560,161 | A | 12/1985 | Hamano |
| 4,560,171 | A | 12/1985 | Anthony |
| 5,092,598 | A | 3/1992 | Kamille |
| 5,823,873 | A | 10/1998 | Moody |

(Continued)

OTHER PUBLICATIONS

Office Action for U.S. Appl. No. 14/281,339 dated Jul. 7, 2016.
Office Action for U.S. Appl. No. 14/281,339 dated Jan. 27, 2017.

*Primary Examiner* — Justin L Myhr
(74) *Attorney, Agent, or Firm* — Altman & Martin; Steven K Martin

(57) ABSTRACT

A player chooses a predetermined number of unique identifiers representing tokens from a set of tokens, forms a player hand from the token values randomly assigned to the chosen identifiers, and compares the player hand to an opponent hand or a pay table. A game can have one or more game segments. Each segment has a different number of cards, a different deck of cards, and/or plays by different rules. A player may play one or more segments in a game. A player may choose the number of consecutive games to play using the same identifier choices and/or the values randomly selected for those choices. In one form, as identifiers are selected or chosen, they are no longer available to be selected or chosen later in the game. Alternatively, identifiers are not removed as they are chosen or selected.

9 Claims, 25 Drawing Sheets

(56) References Cited

U.S. PATENT DOCUMENTS

| | | | |
|---|---|---|---|
| 5,918,884 | A | 7/1999 | DiMuro |
| 5,957,774 | A | 9/1999 | Holmes, Jr. et al. |
| 6,033,306 | A | 3/2000 | De Souza |
| 6,149,156 | A | 11/2000 | Feola |
| 6,206,780 | B1 | 3/2001 | Awada |
| 6,270,405 | B1 | 8/2001 | Ferguson |
| 6,357,749 | B1 | 3/2002 | Feola |
| 6,457,714 | B1 | 10/2002 | Feola |
| 7,481,434 | B1 | 1/2009 | Feola |
| 7,967,673 | B2 | 6/2011 | Muskin |
| 8,333,646 | B2 | 12/2012 | Feola |
| 2002/0036382 | A1 | 3/2002 | Brunelle |
| 2005/0181854 | A1 | 8/2005 | Moshal |
| 2011/0183738 | A1 | 7/2011 | Kirnstötter |
| 2011/0300924 | A1 | 12/2011 | Dahl |
| 2012/0038105 | A1 | 2/2012 | Oh |

Texas Hold'em Pay Table

| | |
|---|---|
| Royal Flush | $250 |
| Straight Flush | $20 |
| Four of a Kind | $7 |
| Full House | $7 |
| Flush | $4 |
| Straight | $3 |
| Three of a Kind | $2 |
| 10 High Two Pair | $1 |

FIG. 1

3-Card Stud Pay Table

| | |
|---|---|
| Straight Flush | 40 to 1 |
| Three of a Kind | 30 to 1 |
| Straight | 6 to 1 |
| Flush | 1 to 1 |

FIG. 2

5-Card Stud Pay Table

| | |
|---|---|
| Royal Flush | 1000 to 1 |
| Straight Flush | 500 to 1 |
| Four of a Kind | 200 to 1 |
| Full House | 50 to 1 |
| Flush | 25 to 1 |
| Straight | 15 to 1 |
| Three of a Kind | 5 to 1 |
| Two Pair | 3 to 1 |
| Jacks or Better | 1 to 1 |

FIG. 3

7-Card Stud Pay Table

| | |
|---|---|
| 7-Card Diamond Royal | 100% 7-Card Jackpot |
| 7-Card Other Royal | 10% 7-Card Jackpot |
| 6-Card Royal | $20,000 |
| 5-Card Royal | $2,000 |
| Straight Flush | $200 |
| Four of a Kind | $50 |
| Full House | $5 |
| Flush | $3 |
| Straight | $2 |
| Three of a Kind | $2 |

FIG. 4

28

KENO GAME

30

82

| | | | | | | | | | | | | |
|---|---|---|---|---|---|---|---|---|---|---|---|---|
| 1 Q♣ | 2 9♠ | 3 J♦ | 4 10♣ | 5 K♣ | 6 Q♦ | 7 3♠ | 8 10♦ | 9 3♣ | 10 7♦ | 11 4♣ | 12 5♦ | 13 9♦ |
| 14 A♣ | 15 2♣ | 16 J♣ | 17 4♥ | 18 10♠ | 19 Q♠ | 20 9♥ | 21 5♠ | 22 A♥ | 23 4♠ | 24 3♥ | 25 7♣ | 26 J♠ |
| 27 6♠ | 28 K♦ | 29 4♦ | 30 7♥ | 31 10♥ | 32 6♥ | 33 2♥ | 34 2♠ | 35 Q♥ | 36 J♥ | 37 8♠ | 38 5♣ | 39 2♦ |
| 40 7♠ | 41 8♣ | 42 K♠ | 43 6♣ | 44 A♦ | 45 8♦ | 46 3♦ | 47 K♥ | 48 A♠ | 49 6♦ | 50 9♣ | 51 5♥ | 52 8♥ |

38

TEXAS HOLD'EM

40

| | | | | | | |
|---|---|---|---|---|---|---|
| 3 J♦ | 32 6♥ | 5 K♣ | 23 4♠ | 16 J♣ | 17 4♥ | 11 4♣ |

3-CARD STUD

42

| | | |
|---|---|---|
| 3 J♦ | 36 J♥ | 22 A♥ |

5-CARD STUD

44

| | | | | |
|---|---|---|---|---|
| 5 K♣ | 23 4♠ | 16 J♣ | 17 4♥ | 11 4♣ |

7-CARD STUD

46

| | | | | | | |
|---|---|---|---|---|---|---|
| 27 6♠ | 10 7♦ | 36 6♥ | 7 3♠ | 14 A♣ | 43 A♠ | 5 K♣ |

PAI GOW POKER

48

| | | | | | | |
|---|---|---|---|---|---|---|
| 37 8♠ | 45 8♦ | 52 8♥ | 43 A♠ | 5 K♣ | 13 10♠ | 31 10♥ |

Next Game: 2:34 Game Number: 12345

FIG. 19

150

152

SCRATCH TICKET

154

| | | | | | | | | | | | | |
|---|---|---|---|---|---|---|---|---|---|---|---|---|
| 1 | 2 | 3 | 4 | 5 | 6 | 7 | 8 | 9 | 10 | 11 | 12 | 13 |
| 14 | 15 | 16 | 17 | 18 | 19 | 20 | 21 | 22 | 23 | 24 | 25 | 26 |
| 27 | 28 | 29 | 30 | 31 | 32 | 33 | 34 | 35 | 36 | 37 | 38 | 39 |
| 40 | 41 | 42 | 43 | 44 | 45 | 46 | 47 | 48 | 49 | 50 | 51 | 52 |

158

Scratch only 7 Cards

| 7-Card Diamond Royal | 100% Jackpot | 7-Card Other Royal | 10% Jackpot |
|---|---|---|---|
| 6-Card Royal | $20,000 | 5-Card Royal | $2,000 |
| Straight Flush | $200 | Four of a Kind | $50 |
| Full House | $5 | Flush | $3 |
| Straight | $2 | Three of a Kind | $2 |

FIG. 29

150

152

SCRATCH TICKET

154

| | | | | | | | | | | | |
|---|---|---|---|---|---|---|---|---|---|---|---|
| 1 | 2 | 3 | 4 | 5 | 6 | 7 | 8 | 9 | 10 | 11 | 12 |
| 13 | 14 | 15 | 16 | 17 | 18 | 19 | 20 | 21 | 22 | 23 | 24 |
| 25 | 26 | 27 | 28 | 29 | 30 | 31 | 32 | 33 | 34 | 35 | 36 |
| 37 | 38 | 39 | 40 | 41 | 42 | 43 | 44 | 45 | 46 | 47 | |

| 1 | 2 | 3 | 4 | 5 |
|---|---|---|---|---|

158

Scratch only 2 Grid Cards and all 5 Community Cards

| 7-Card Diamond Royal | 100% Jackpot | 7-Card Other Royal | 10% Jackpot |
|---|---|---|---|
| 6-Card Royal | $20,000 | 5-Card Royal | $2,000 |
| Straight Flush | $200 | Four of a Kind | $50 |
| Full House | $5 | Flush | $3 |
| Straight | $2 | Three of a Kind | $2 |

FIG. 30

METHOD AND APPARATUS FOR PLAYING A POKER-TYPE KENO GAME

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to games of chance, more specifically, to a card game that allows a player to play one or more individual card game against the house at a time.

2. Description of the Related Art

There are a number of games for gambling where winners and losers are determined immediately or almost immediately after the wager is made. Such games include keno, video poker, and scratch and pull-tab tickets.

In keno, the player chooses numbers up to a maximum, for example, choosing 10 numbers between 1 and 80. The more numbers that are matched, the greater the payout. Variations include allowing the player to select a variable number of numbers, for example, between 1 and 15 number. When run by a state, the winning numbers are drawn periodically during the day, such as every 15 minutes, and players who have chosen their numbers prior to the drawing participate. Players find out quickly whether they win or lose and then the cycle starts over again.

With scratch and pull-tab tickets, the player buys the ticket and either scratches spots or opens tabs according to the instructions for the ticket. The player knows immediately whether she is a winner or not. With traditional scratch tickets, however, the player has little choice in what locations to scratch or open. For example, if the game being played is poker-based, the player will not be able to choose from all of the possible 52 cards because there is limited space on the ticket. This means that tickets are predetermined to be winners or losers.

Probability tickets are different in that every ticket has the potential to be a winner. There are a number of spots to scratch and the player chooses some of them, as indicated by the rules. However, the player still does not have a choice of all 52 cards.

BRIEF SUMMARY OF THE INVENTION

In the game of the present invention, a player chooses a predetermined number of unique identifiers representing tokens from an available set of tokens, and forms a player hand from the values randomly assigned to the chosen identifiers. In one embodiment, the opponent embodiment, the player hand is compared to a corresponding opponent hand of randomly-selected token values.

Optionally, the winning player hand is also compared to a pay table to determine the amount won. In another embodiment, the pay table embodiment, the player hand is compared to a pay table, rather than to a corresponding opponent hand, to determine the player's payout.

Each playing token in a set is individually identified without knowing the value that the tokens represent by a set of unique identifiers (IDs), the number of which is the same as the number of playing tokens in the set. For a standard poker deck of 52 cards, the IDs can be the numbers 1-52. The player chooses cards for her hand(s) without knowing the values of the cards by using the IDs.

Winning hands are determined by the base game that is being played. When the set of tokens is a poker deck of cards, the winning hand will typically be determined by poker rankings, which is merely a convenience because most people know the poker rankings. Other card value combinations are contemplated for determining winning hands and can be from games such as blackjack, baccarat, Pai Gow tiles, slots, or any other game having combinations of symbols having ranks that can be compared. Unless otherwise indicated, the remainder of the specification assumes a poker deck and poker rankings.

In the opponent embodiment of the game, there are two actors, the player and the opponent. The player wagers on the outcome and controls the player hand. The opponent is the entity that is behind the hands the player is playing against, typically, a casino, a state lottery, etc. In many cases, a computer plays for the opponent. The computer has two additional responsibilities, to randomly select values to associate with the tokens and to randomly select the IDs for the opponent hand and any community cards.

In the pay table embodiment of the game, there is one actor, the player. The player wagers on the outcome and controls the player hand. A computer has one responsibility, to randomly select values to associate with the tokens.

A game can have one or more game segments. Each segment has a different number of cards, a different deck of cards, and/or plays by different rules. For example, a game can have five segments: a Texas Hold'em segment, a three-card stud segment, a five-card stud segment, a seven-card stud segment, and a Pai Gow Poker segment. A player may play one or more segments in a game. The player may play the same segment more than once in a game. Different segments may have the same type of hand. The player may be able to specify the number of cards to play in a segment.

In one form of the game, as IDs are selected or chosen, they are no longer available to be selected or chosen later in the game. Alternatively, IDs are not removed from the deck as they are chosen or selected. In this scenario, segment hands and/or opponent hands can have some of the same IDs. In the extreme case, the player hand and opponent hand will have all of the same IDs, that is, the player and opponent hands will be identical.

The present invention also contemplates that game segments can implement rules that have community cards, such as Texas Hold'em. The computer selects two IDs as the opponent hand and five IDs as the community cards. The opponent Texas Hold'em hand is comprised of the combination of the values of the two IDs for the opponent hand of the Texas Hold'em segment and the values of the five IDs for the five-card stud segment. The player Texas Hold'em hand is comprised of the combination of the values of the two IDs for the player hand of the Texas Hold'em segment and the values of the five IDs for the five-card stud segment.

The game begins with the player choosing which segments she will participate in, which IDs to play for each segment, the amount to wager for each segment, how many consecutive games to play with the choices, and whether the consecutive games will use the ID choices and/or values.

How segments and IDs are chosen depends upon the medium on which the game is played. Optionally, the player receives feedback confirming the segments and IDs she has chosen and the amount wagered.

In the opponent embodiment, the computer randomly selects IDs for the opponent hand for each segment and randomly selects card values for each of the IDs. At the appropriate time, the opponent hands and the card values associated with the IDs are revealed. The rank of the player and opponent hands for each segment are determined by using the combination of the values corresponding to the IDs in the player and opponent hands, respectively. Then the ranks of the player and opponent hands for each segment are compared to determine whether or not the player won.

In the pay table embodiment, the computer randomly selects card values for each of the IDs. At the appropriate time, the card values associated with the IDs are revealed. The rank of the player hand for each segment is determined by using the combination of the values corresponding to the IDs in the player hands. Then the rank of the player hands for each segment are compared to a pay table to determine if the player receives a payout.

The present invention contemplates that the game of the present invention may be played on a variety of media, including keno-type systems, bingo-type systems, over a network, on stand-alone machines, multi-player systems, social media systems, live table games, and as paper and video scratch and pull-tab tickets. Also, combinations of a computer and a live opponent are contemplated.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein:

FIG. 1 shows an example pay table for Texas Hold'em;

FIG. 2 shows an example pay table for three-card stud;

FIG. 3 shows an example pay table for five-card stud;

FIG. 4 shows an example pay table for seven-card stud;

FIG. 19 shows the display of FIG. 14 after card values have been revealed;

FIG. 29 shows a probability scratch ticket implementing the pay table embodiment of the game of the present invention;

FIG. 30 shows a probability scratch ticket implementing the Texas Hold'em pay table embodiment of the game of the present invention;

DETAILED DESCRIPTION OF THE INVENTION

Figure 5:
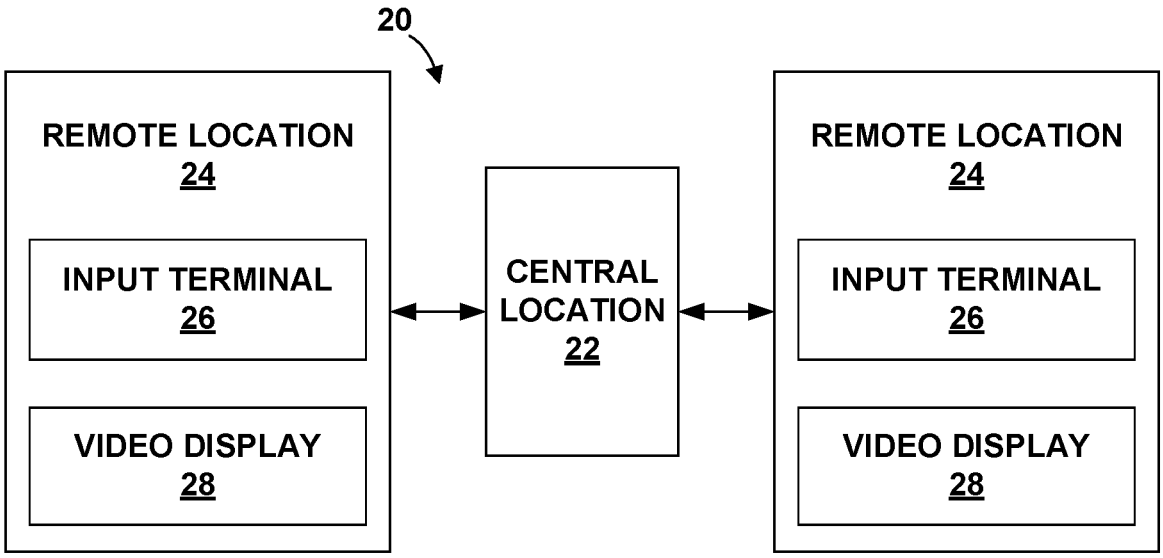
FIG. 5 is a block diagram of a keno-type system.

The card game of the present invention is played with a set of basic rules and includes a number of optional enhancements. In the opponent embodiment, the basic game is that a player chooses a number of tokens from an available set of tokens, forms a player hand from the values randomly assigned to the chosen tokens, and compares the player hand to a corresponding opponent hand of randomly-selected tokens. The number of tokens depends on the game being played and can be one token or more. Optionally, if the player hand wins, the player hand is also compared to a schedule of hands found in a pay table to determine the amount won.

In the pay table embodiment, the basic game is that a player chooses a predetermined number of tokens from an available set of tokens, forms a player hand from the values randomly assigned to the chosen tokens, and compares the player hand to a schedule of hands found in a pay table to determine the amount, if any, that the player wins. The predetermined number of tokens depends on the game being played and can be one token or more.

The term "playing token" is used in the present application to indicate a playing card, a playing tile, a symbol used to represent values, or any facsimile thereof. For example, a playing token can be a paper playing card, a physical playing tile, an image of a card or tile on a video display, an image of a card or tile on a scratch ticket, etc. Any representation of a playing card or tile is contemplated.

A "set of playing tokens" refers to the entire number of playing tokens that are used for the game. The set of playing tokens can be a complete deck of playing cards, a set of Pai Gow tiles, etc. An example of a set of playing tokens is a standard poker deck, which is intended to encompass a standard deck of 52 poker cards (2-10, Jack, Queen, King, Ace of hearts, diamonds, clubs, spades) as well as a deck that includes one or more jokers, such as the 53 card deck used for Pai Gow poker, and/or wild cards, and/or semi-wild cards. Another example of a set of playing tokens is a set of 32 Pai Gow tiles. It is also contemplated that decks of cards with different symbols can be used.

Each playing token of a set has a value. For a standard poker deck of 52 cards, the value includes the suit (hearts, diamonds, clubs, spades) and number (2-10, Jack, Queen, King, Ace). For a standard set of 32 Pai Gow tiles, the value is the set of pips on the tiles.

The present invention may require that each of the playing tokens in a set be individually identified without knowing the value that the token represents. Consequently, there is a set of unique identifiers (IDs), the number of which is the same or less than the number of playing tokens in a set, depending on the rules of the particular game. For a standard poker deck of 52 cards, the IDs can be the numbers 1-52 or can be 1-53 if a joker is included. For a standard set of 32 Pai Gow tiles, the IDs can be the numbers 1-32.

Sometime during the course of the game, the player chooses tokens for her hand(s) without knowing the values of the tokens. Token choices are made using the IDs. For example, for a three-card stud game, the player chooses three cards of unknown value by choosing three IDs, that is, three numbers between 1 and 52. How those three IDs are chosen is specific to the medium on which the game is played and the particular embodiment of that medium, as explained below.

At a point in the game, each ID is randomly assigned a value from the set of playing token values. When these values are revealed, the player knows the values of the IDs chosen.

As described below, winning hands are determined by the base game that is being played. When poker playing cards are used, the winning hand will typically be determined by poker rankings. The use of poker rankings is merely a convenience and is used primarily because most people know the poker rankings and know that it is more difficult to get, for example, a straight than a pair. When Pai Gow tiles are used, the winning hand will be determined by Pai Gow rankings.

The typical stud poker hand has five or seven cards, as in five-card stud, seven-card stud, Pai Gow poker (seven cards), and Texas Hold'em poker (seven cards). However, many kinds of poker-type games can be used with the present invention, such as 3-card stud, the commonality between the games being that the winning hand is determined using poker rankings. The hand can have any number of cards, from one card or more.

Although poker ranking are used throughout the present specification, the present invention contemplates that other methods of ranking to determine the winning hand can be used. Other card value combinations are contemplated for determining winning hands, for example, a hand of all even numbered cards, a hand with at least one card from each suit, a lowest-rank hand (e.g. 2, 3, 4, 5, 7, or where the sum of the card values is less than or greater than that of the opponents hand to win. Other card value combinations for determining ranking can be from games such as blackjack, baccarat, Pai Gow tiles, slots, or any other game having combinations of symbols having ranks that can be compared.

Unless otherwise indicated, the remainder of the specification assumes that the game is based upon poker hands and poker rankings.

The opponent embodiment of the game has two actors, the player and the opponent. The player is the person who wagers on the outcome of the game, controls the player hand, and makes choices that influence the outcome. The term "choose" in all its forms ("chosen", "choice", etc.) is used in the present specification to refer to player actions and results.

The opponent is the entity that is behind the hands the player is playing against. In other words, if the player loses, the opponent is the winner. Typically, the opponent will be a casino, a state lottery, a dealer, a banker, etc. In many cases, a computer is playing for the opponent.

In addition to playing for the opponent, the computer has two responsibilities. One responsibility is to randomly select values for the IDs. Another responsibility is to randomly select the values or IDs for the opponent hand(s), which are the hand(s) to which the player hand(s) are compared, and to randomly select values or IDs for any community cards being used. In the remainder of the present specification and unless described otherwise, selecting values or IDs for opponent hands is meant to include selecting values or IDs for any community cards. The term "select" in all its forms ("selected", "selection", etc.) is used in the present specification to refer to computer actions and results.

As indicated above, the player compares her hand against the opponent hand. The amount of the payout for the player hand having a higher rank than the opponent hand is determined by the rules of the game. Typically, it will be a multiple of the amount wagered. How a tie is handled is also determined by the rules of the game.

Typically, winnings will be monetary in nature. However, the present invention contemplates that winnings can be non-monetary, such as toys, gifts, coupons, or other non-monetary prizes. The present invention also contemplates that the game can be played for fun, that is, nothing is wagered to play.

Optionally, if the player hand has a higher rank than the opponent hand, the payout amount is determined by the rank of the player hand. In such a case, a pay table is used to determine the payout based on the player hand rank.

There are several ways that the pay table can be implemented, assuming a win by the player. Several pay table implementations are shown in FIGS. 1-4. In one implementation, the player receives a fixed multiple of the amount that the player originally wagered, as in FIGS. 2 and 3. For example, if a player gets a full house and beats the opponent hand, she receives 50 times the amount that she wagered. In a second implementation, the player receives a fixed amount, as in FIGS. 1 and 4. For example, if a player gets a full house and beats the opponent hand, she receives $7. In a third implementation, the player receives a percentage of a jackpot that is comprised of all or part of the wagers from all of the players, as in FIG. 4. For example, if a player gets a 7-card royal flush in spades and beats the opponent hand, she receives 10% of the 7-card jackpot. The fourth implementation is similar to the third, except that the percentage is taken from a progressive jackpot, which is an accumulation of some percentage of the wagers from the previous games. Jackpots can accumulate from games in various defined areas, such as in the same establishment, same state, same country, or worldwide. Each game may use only one method or various combinations of methods.

Optionally, even if the player hand loses to the opponent hand, the player hand is compared to a pay table. The pay table can be the same as if the player won or the pay table can be different. In the latter case, the player typically gets a smaller payout if she loses than if she wins.

Optionally, the payout can also be determined by the rank of the losing opponent hand. In such a case, the pay table is generated to account for various combinations of player and opponent hand ranks and the payout associated with each of those combinations.

The pay table embodiment of the game has one actor, the player. The player is the person who wagers on the outcome of the game, controls the player hand, and makes choices that influence the outcome.

In addition to the player, there is typically a computer that is responsible for randomly selecting values for the IDs. Another responsibility is to randomly select values or IDs for any community cards being used.

As indicated above, the payout a player receives is determined by comparing the rank of the player hand to the ranks found in a pay table. The pay table can be implemented in all of the ways described above.

Optionally, the game can be played with one or more side bets and/or jackpots as an adjunct to the game of the present invention. Those players that play the game are given the option of playing a side bet and/or jackpot. It is optional with the house whether or not to allow a side bet or jackpot to be played without also playing the game. Only those players who wager on a side bet are eligible to win that side bet.

One possible side bet or jackpot allows a player to wager that the player hand will have a rank that is found in a pay table. Another possible side bet or jackpot allows a player to wager that any one of the player hands will have a rank that is found in a pay table. Another possible side bet or jackpot allows a player to wager that the opponent hand will have a rank that is found in a pay table. Another possible side bet or jackpot allows a player to wager that any one of the opponent hands will have a rank that is found in a pay table. Another possible side bet or jackpot allows a player to wager that a combination of one or more player hands and one or more opponent hands will determine the payout. Another possible side bet or jackpot allows a player to wager that a bonus hand comprised of a combination of one or more cards from the player hand and one or more cards from the opponent hand is found in a pay table.

A game can have one or more game segments. If there is more than one game segment, each segment typically has a different number of cards, a different set of card values, and/or plays by different rules. For example, a game can have five segments: a Texas Hold'em segment, a three-card stud segment, a five-card stud segment, a seven-card stud segment, and a Pai Gow Poker segment. A player may play one or more segments in a game. For example, a player may choose to play the three-card stud and seven-card stud segments, while not playing the Texas Hold'em, five-card stud, or Pai Gow Poker segments. In another example, a player may choose to play the seven-card stud segment and the Pai Gow poker segment. For seven-card stud, the player chooses seven IDs from 52 IDs (the number of cards in a standard poker deck) and for Pai Gow poker, the player chooses seven IDs from 53 IDs (the number of cards in a standard poker deck plus one joker, as is typically used for Pai Gow poker). The remainder of the present specification uses as an example a game that has five segments: a Texas Hold'em segment, a three-card stud segment, a five-card stud segment, a seven-card stud segment, and a Pai Gow Poker segment.

The present invention contemplates that different segments may have the same type of hand. For example, there may be two segments of five-card stud. In one configuration, each opponent hand has one corresponding player hand. In another configuration, a single player hand is compared to multiple opponent hands of the same type. In another configuration, a single opponent hand is compared to multiple player hands of the same type.

The present invention contemplates that the player may be able to specify the number of cards to play in a segment. For example, if the player chooses four IDs for a segment, the opponent hand will also have four cards.

The total number of IDs that are chosen depends upon which segments are being played, how many IDs are needed for the segment, and on whether the same chosen IDs must be played for all segments or different IDs may be played for each segment. In an example of the former, if the player chooses to play both the five-card and the seven-card stud segments, she chooses five IDs for the five-card stud segment and two additional IDs for the seven-card stud segment so that the hand for the seven-card stud segment is a combination of the five cards from the five-card stud segment and the two additional cards. In an example of the later, if the player chooses to play both the five-card stud segment and the seven-card stud segment, she chooses five IDs for the five-card stud segment and seven IDs for the seven-card stud segment.

The present invention contemplates that, as IDs are selected or chosen, they are no longer available to be selected or chosen later in the game. In one scenario, the computer is only permitted to select IDs for the opponent hand that the player has not already chosen. In other words, the values corresponding to the IDs chosen by the player for the player hand are removed from the deck before the computer selects IDs for the opponent hand.

In a second scenario, the player is only permitted to choose IDs that the computer has not selected for the opponent hand. In other words, the values randomly selected by the computer for the opponent hand are removed from the deck before the player chooses IDs for the player hand. The number of IDs available to the player is reduced by the number of cards in the opponent hand. In one example, if the game segment is seven-card stud, there will only be 45 IDs for the player to choose from. Seven values are randomly selected for the opponent hand and then the remaining 45 values are randomly selected for the 45 IDs. In another example, if the game segment is Pai Gow tiles, there will only be 28 IDs for the player to choose from. Four values are randomly selected for the opponent hand and then the remaining 28 values are randomly selected for the 28 IDs. In these two scenarios, the player hand and opponent hand cannot have any of the same values.

The present invention also contemplates that values are not removed from the deck as they are chosen or selected. There are two basic scenarios. In the first scenario, the player chooses IDs for each segment from the entire set of 52 IDs. In this scenario, segment hands can have some of the same IDs. For example, hands chosen for three-card stud and seven-card stud can have some of the same IDs because the IDs for each segment are chosen from the entire set of 52 IDs. In another example, the player can choose the same seven IDs for seven-card stud and Pai Gow poker.

In the second scenario, the player chooses IDs for the player hand from the entire set of IDs and the computer selects IDs for the opponent hand from the entire set of IDs. In this scenario, it is possible that the player hand, opponent hand, and/or community cards can have IDs in common, that is, the player hand, opponent hand, and/or community cards can have some of the same IDs. In the extreme case, the player hand and opponent hand will have all of the same IDs, that is, the player and opponent hands will be identical. Optionally, this is the basis for a bonus.

When community cards are being used, either the community card and opponent values are removed from the set of values when selected so there will be no duplicate values, or the community card and opponent values are selected from the entire set of values so that there can be duplicate values between the opponent hand and the community cards.

The present invention contemplates that various combinations of removing IDs and not removing IDs can be used and the rules of the particular game and/or game segment will determine the combinations.

For each segment of the opponent embodiment, the player hand is compared to an opponent hand of the same number of cards. In other words, the combination of the values assigned to the IDs in the player hand are compared to the combination of the values in the opponent hand. For example, the player three-card stud hand is compared to the opponent three-card stud hand. Optionally, the opponent hand has a different number of cards, which can, depending on whether the opponent hand has fewer or more cards than the player hand, skew the odds in favor of the player or the opponent. When the player and opponent hands have different numbers of cards, the smaller number is used for comparison. For example, if the player hand has six cards and the opponent hand has five cards, the best five cards in the player hand is compared to the five-card opponent hand.

The present invention also contemplates that game segments can implement rules that include community cards, such as Texas Hold'em. The player chooses two IDs as the player hand. For the opponent embodiment, the computer selects two IDs as the opponent hand and five IDs as the community cards. Optionally, the five IDs from the five-card stud segment can be used as the community cards. For example, the computer selects two IDs for the Texas Hold'em segment, three IDs for the three-card stud segment, five IDs for the five-card stud segment, and seven IDs for the seven-card stud segment. The opponent Texas Hold'em hand is comprised of the combination of the values of the two IDs for the opponent hand of the Texas Hold'em segment and the values of the five community card IDs. The player Texas Hold'em hand is comprised of the combination of the values of the two IDs for the player hand of the Texas Hold'em segment and the values of the five community card IDs.

For the pay table embodiment, the computer selects five IDs as the community cards. The player Texas Hold'em hand is comprised of the combination of the values of the two IDs of the player hand of the Texas Hold'em segment and the values of the five community card IDs.

The present invention also contemplates that a form of blackjack or baccarat can be implemented. The player chooses two IDs as her initial hand and the computer selects two IDs as the opponent initial hand. The game is played using house rules. For blackjack, this typically means that the hand takes another card if the total of the card values is below 17. For baccarat, this typically means using the rules of punto banco baccarat where the player hand takes another card if the card total is below 6, and whether or not the opponent takes another card depends on the initial two cards for each hand. After the card values are revealed, the computer plays both the player hand and the opponent hand per the house rules.

For each segment of the pay table embodiment, the player hand is compared to the pay table for that particular segment.

The game of the present invention begins with the player choosing which one or more segments she will participate in, choosing the IDs for each chosen segment, and, optionally, wagering an amount for each chosen segment. Optionally, the player also chooses how may consecutive games to play with the segment choices and whether those consecutive games will be played with the same ID choices or the values assigned to those IDs in the first of the consecutive games. How the player chooses the segments, IDs, number of consecutive games, and IDs/values depends upon the medium on which the game is played, and is described in detail below with the description of each medium.

Typically, the player will wager on the outcome of the game. Wagering may not occur when the game is being played strictly for fun, such as a hand held video game or as a game in a game arcade. Any manner in which the player can make a wager is contemplated by the present invention where the possibilities are dictated by the medium on which the game is played. Examples of methods of indicating the amount wagered by the player are described below with reference to the various playing media.

Optionally, the player receives feedback confirming the segments and IDs she has chosen and the amount wagered. The manner in which feedback is given depends on the medium on which the game is played and is described below with reference to the various playing media.

The timing of the player choices depends upon the manner in which the game is played. There are two basic forms. In the first, the timing is controlled by the player where the choosing process is not complete until the player has made her choices. An example of this timing is where the player is playing at a standalone machine in a casino or on a scratch ticket. In the second form, the timing is controlled by a clock where each game begins at a fixed time and all players participating in a game must have their choices made prior to that time. An example of this timing is where the player is playing a public state-run keno-type game at one of numerous parlors throughout the state.

In the opponent embodiment, the computer randomly selects the IDs for the opponent hand for each segment and randomly assigns values to each of the IDs. Alternatively, the computer directly selects values for the opponent hand and then randomly assigns the remaining values to the IDs. Except in limited circumstances, the timing of the random selection for the opponent hands and IDs is not important. Since the opponent hands and values are not revealed to the player until the appropriate time during the game, they may be randomly selected at any time prior to being revealed.

One of the limited circumstances is the situation where the player-chosen IDs are removed before the computer selects IDs for the opponent hand.

In the pay table embodiment, the computer randomly assigns values to each of the IDs. Except in limited circumstances, the timing of the random selection for the IDs is not important. Since the values are not revealed to the player until the appropriate time during the game, they may be randomly selected at any time prior to being revealed.

At the appropriate time, the values associated with the IDs are revealed and, in the opponent embodiment, the opponent hands are revealed. After the values and opponent hands are revealed, the rank of the player hand for each segment is determined by using the combination of the values assigned to the IDs in the player hand of the segment. If the player chose to play consecutive games with the same IDs, the rank of the player hand is determined by using the combination of the values assigned to the player hand IDs from the first of the consecutive games. If, in the opponent embodiment, the player chose to play consecutive games with the same values, the rank of the player hand is the same as the rank of the player hand from the first of the consecutive games.

The rank of the opponent hand for each segment is determined by using the combination of the values either in the opponent hand or assigned to the IDs in the opponent hand of the segment. In the opponent embodiment, the rank of the player hand for each segment is compared to the rank of the opponent hand for the same segment to determine whether or not the player won. In the pay table embodiment, the rank of the player hand for each segment is compared against the pay table for the same segment to determine whether or not and how much the player won.

Typically, if the opponent is a casino, state lottery, etc. (the house), it retains a house advantage to guarantee that it will win over the long term. The present invention contemplates that the house can be given an advantage in one or more of any number of ways, including, but not limited to: (1) by having more cards in the opponent hand than the player hand; (2) by requiring the player to pay an ante or vigorish and allowing the house to determine if and how much of the ante is retained by the house; (3) by requiring an ante and allowing a bonus to be awarded on one or more sets of community cards; (4) by requiring an ante/bonus wager and paying a bonus on only the highest hand; (5) by requiring the house to have a minimum ranked hand in order to challenge the player's hand; and/or (6) by requiring the player to have a minimum ranked hand in order to qualify for a winning hand. In an example of the later, the player must have a pair or better in order to qualify for a winning hand.

The opponent hands and assigned values can be revealed all at once or can be revealed in a progression. The advantage to revealing all of the opponent hands and assigned values at once is that the game is over more quickly and more games can be played during a given period of time. This may be appropriate for, for example, a keno-type game that plays periodically, such as every four minutes.

The advantage to revealing opponent hands and assigned values in a progression is that the suspense of the game is enhanced because of the extended time over which the game is played. In one example, initially all of the assigned values are revealed but only the three-card stud opponent hand is revealed. After the winners of the three-card stud segment are paid, the five-card stud opponent hand is revealed. After the winners of the five-card stud segment are paid, the seven-card stud opponent hand is revealed and the winners of the seven-card stud segment are paid. Alternatively, payouts are held until the end of the game, when payouts for all of the segments are made at the same time. The present invention contemplates that payouts can be made at any time as per the rules of the game.

Optionally, one or more values from the opponent hands and/or community cards can be revealed prior to the player choosing IDs and/or wagering. Optionally, one or more values assigned to IDs can be revealed prior to the player choosing IDs and/or wagering.

The present invention contemplates that the game of the present invention may be played on a variety of media, including keno-type systems, bingo-type systems, over a network, on stand-alone machines, multi-player systems, social media systems, live table games, and as paper and video scratch and pull-tab tickets. Also, combinations of a computer and a live opponent are contemplated.

A block diagram of a keno-type system 20 is shown in FIG. 5. There is a central location 22 from where the game is controlled. The central location 22 has a computer that acts as the opponent. There are a number of remote locations 24 from where player choices and wagers are received at input terminals 26 and where the game is shown to the players on video displays 28. All elements of the game may be shown on one display. Alternatively, some elements of the game may be shown on one display while other element are shown on another display. Alternatively, a single display may alternate between displaying different elements of the game. The information transfer between the remote locations 24 and central location 22 can occur on any communications system, including local-area and wide-area networks. In local-area networks, the remote locations 24 and central location 22 are in close proximity to each other, such as in a building complex, a single building, or a single room. In wide-area networks, there is generally no limitation as to how far the locations 22, 24 are from each other. Communication typically occurs over private leased lines or over public lines such as Internet connections. In some cases, the communication is wireless.

A playing grid 30 is displayed on video display 58 visible to the players at the remote location 24. The playing grid 30 has a grid location 32 for each card available to be chosen. Typically, there are 52 grid locations in the playing grid 30 representing the number of cards in a standard poker deck. Alternatively, the playing grid 30 may have fewer or more grid locations 32 if a deck other than the standard 52-card poker deck is used. Examples include the 32 tiles of Pai Gow tiles and the 53 cards of Pai Gow Poker when using a wild card. Each grid location 32 is denoted by a unique ID 34, for example, the numerals 1-52.

Figure 6:
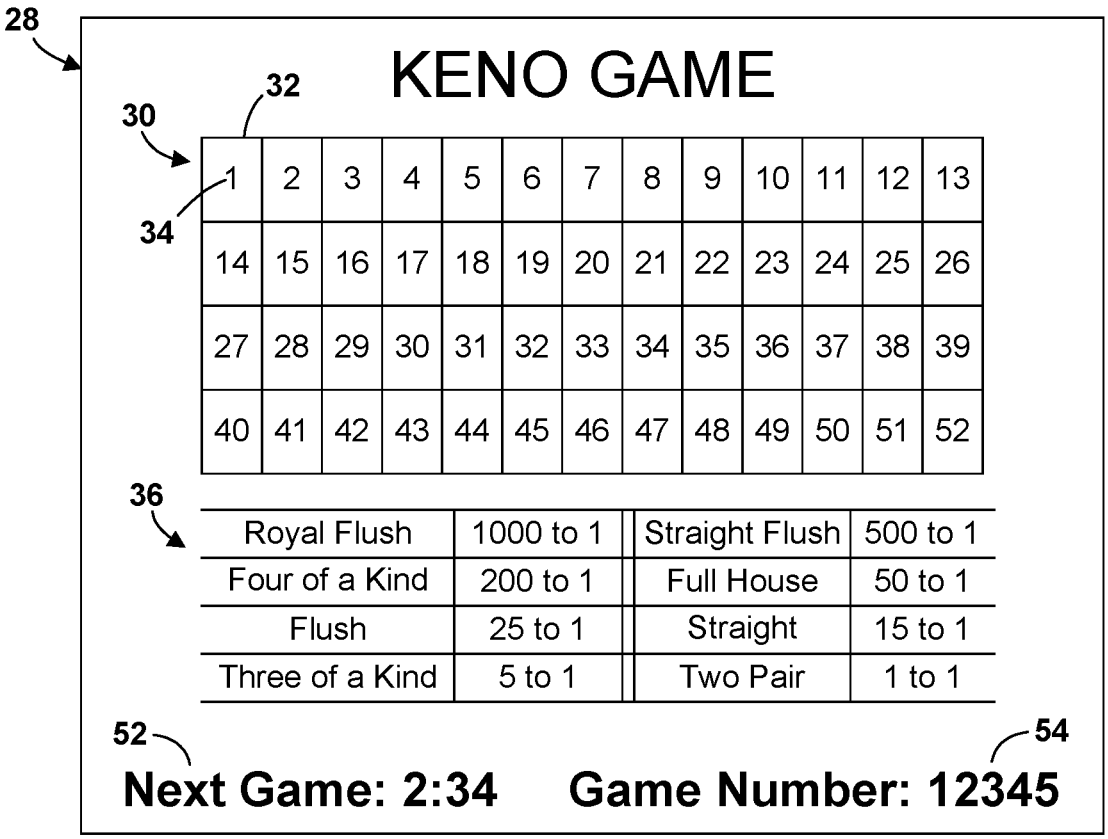
FIG. 6 shows a display implementing a keno-type embodiment of the pay table embodiment of the game of the present invention with one segment and duplicate cards.
Figure 9:
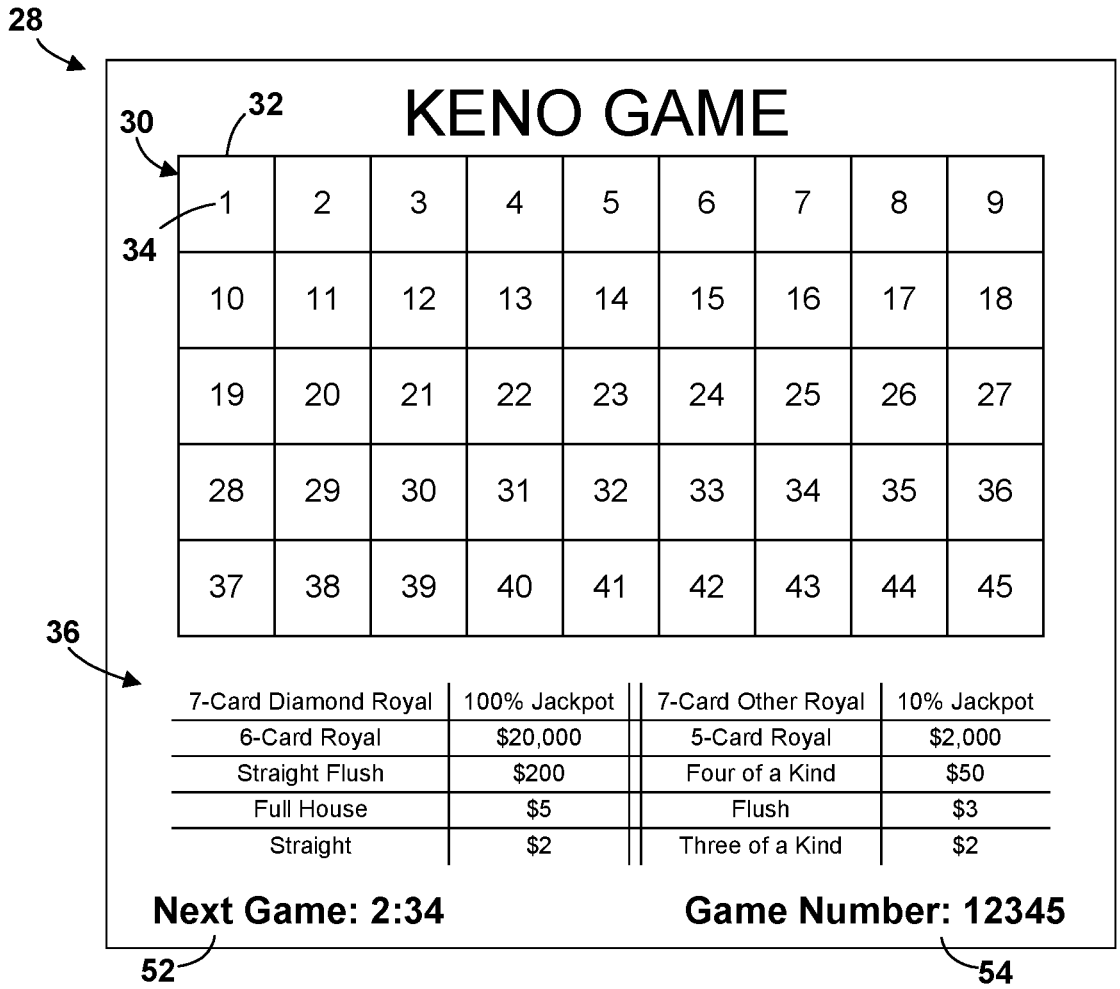
FIG. 9 shows a display implementing a keno-type embodiment of the pay table embodiment of the game of the present invention with one segment and non-duplicate cards.
Figure 10:
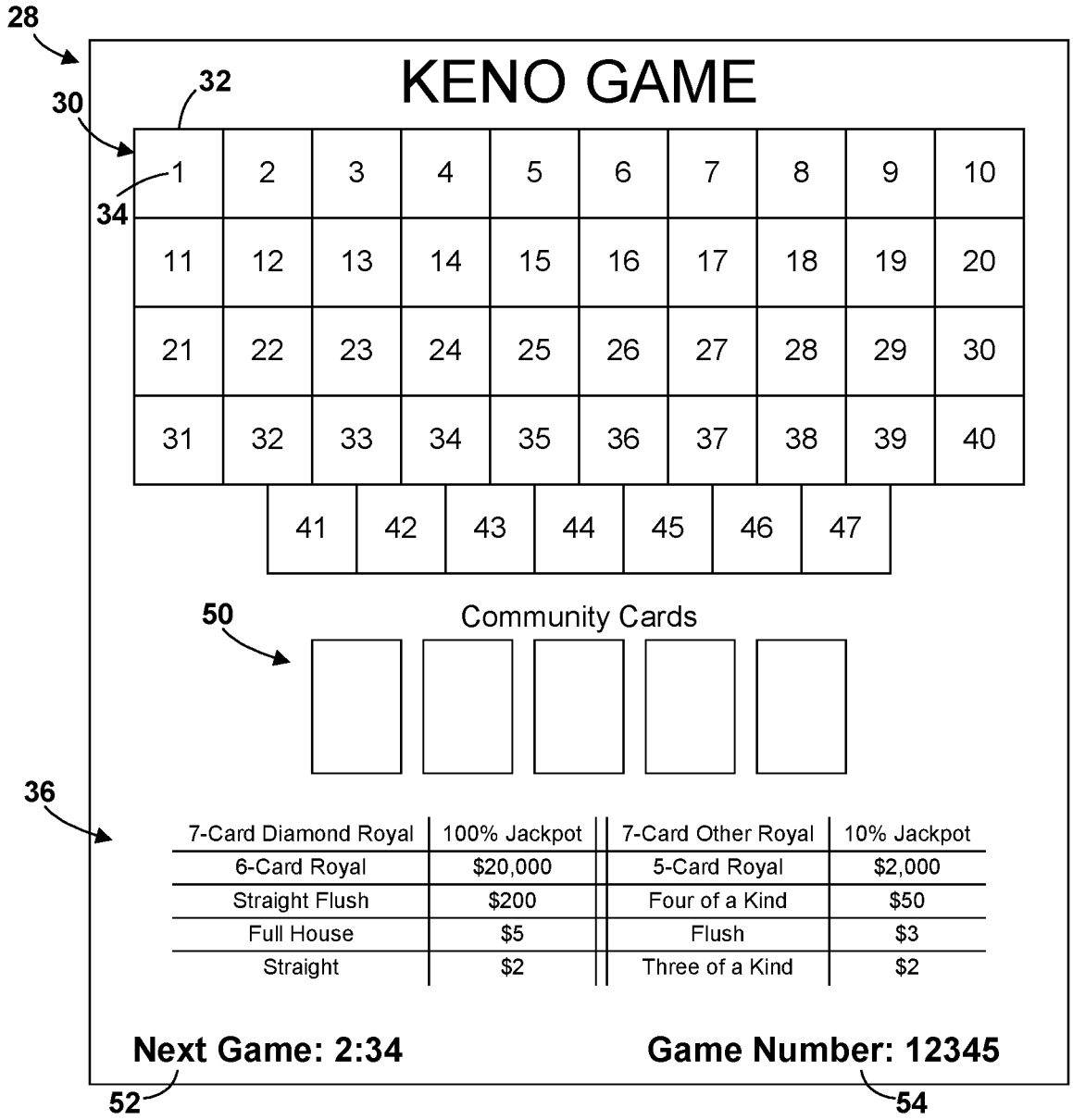
FIG. 10 shows a display implementing a keno-type embodiment of the pay table embodiment of the game of the present invention with one Texas Hold'em segment and non-duplicate cards.

For the pay table embodiment, only the playing grid 30 is shown, as in FIGS. 6 and 9, or only the playing grid 30 and the community cards 50 are shown for the Texas Hold'em implementation, as in FIG. 10. Optionally, the pay table 36 is also shown.

Figure 7:
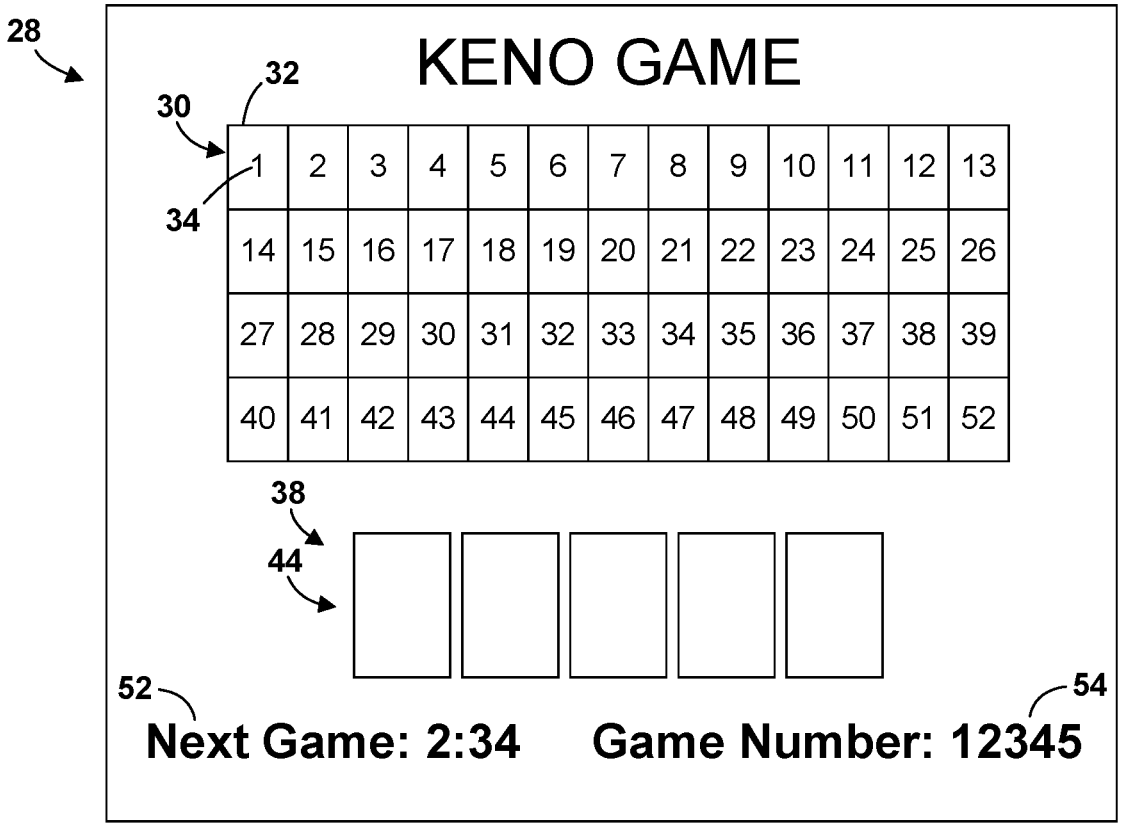
FIG. 7 shows a display implementing a keno-type embodiment of the opponent embodiment of the game of the present invention with one segment and duplicate cards.
Figure 11:
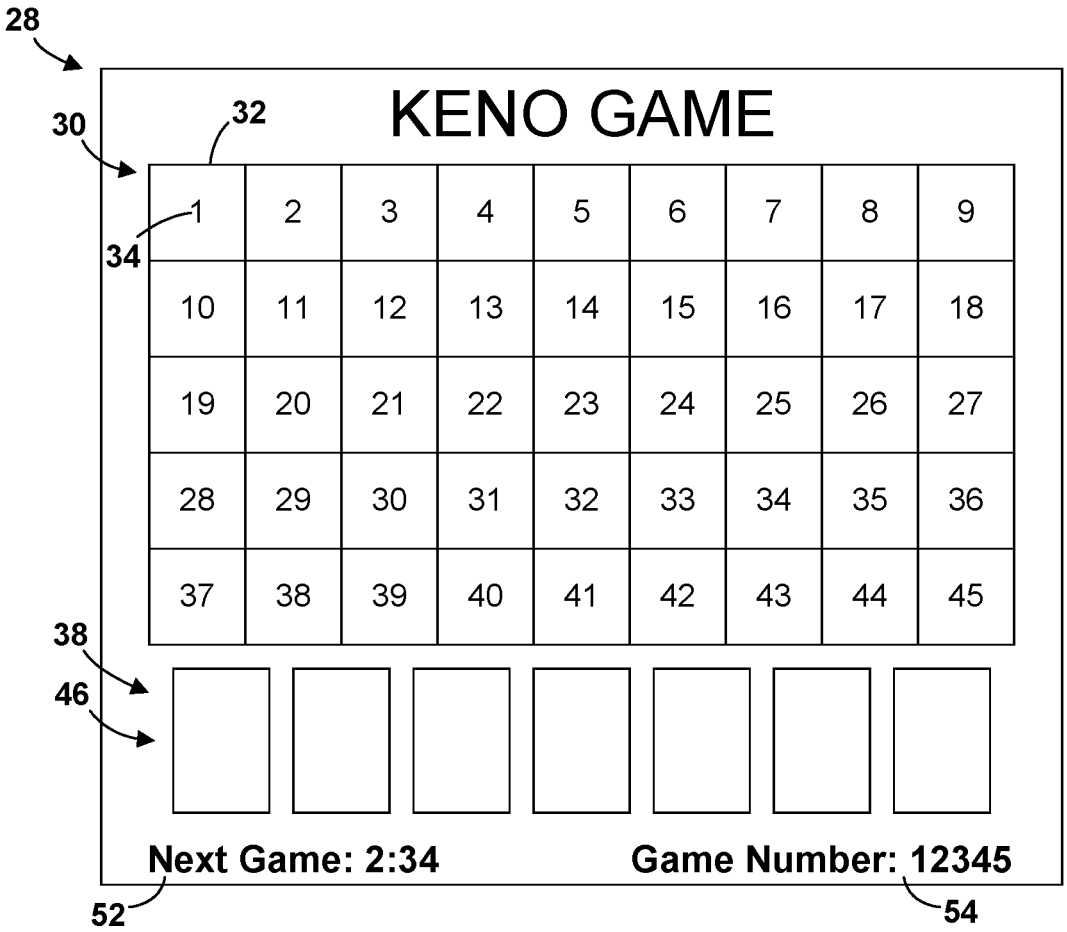
FIG. 11 shows a display implementing a keno-type embodiment of the opponent embodiment of the game of the present invention with one segment and non-duplicate cards.
Figure 14:
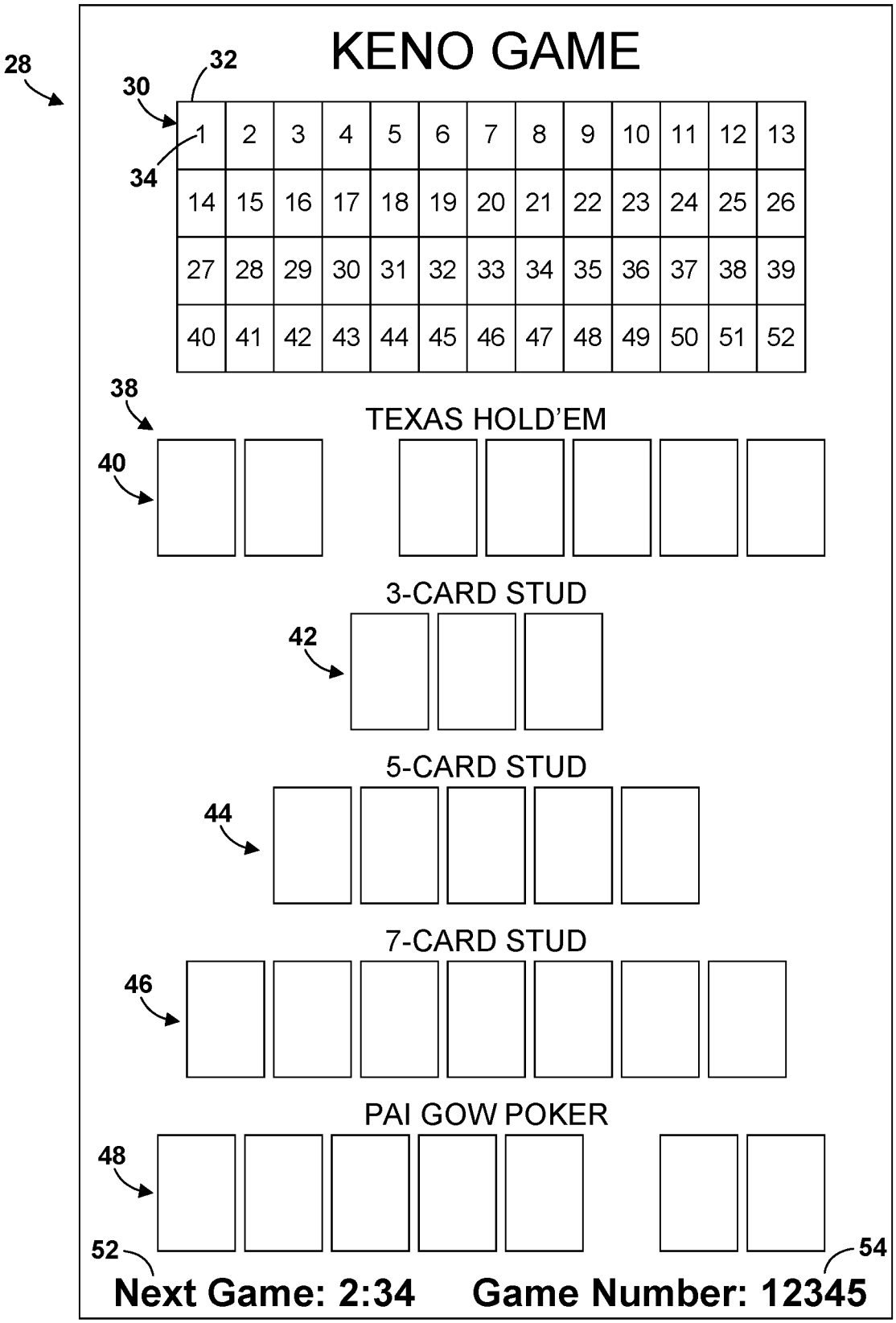
FIG. 14 shows a display implementing a keno-type embodiment of the opponent embodiment of the game of the present invention with five segments.

For the opponent embodiment, the opponent hands 38 are also shown on the display 58. There is an opponent hand for each game segment. In the example of FIG. 7, there is one game segment: 5-Card Stud 44, where the player hand and opponent hand can have duplicate IDs. In the example of FIG. 11, there is one game segment: 7-Card Stud 46, where the player hand and opponent hand cannot have duplicate IDs. After the seven opponent hand values are selected, there are 45 cards left for the player to choose from, hence IDs from 1 to 45, rather than 1 to 52. In the example of FIG. 14, there are five game segments: Texas Hold'em 40, 3-Card Stud 42, 5-Card Stud 44, 7-Card Stud 46, and Pai Gow Poker 48, where the player hands and opponent hands can have duplicate IDs.

Other information may be shown in the display 28, such as the countdown to the next game 52 and the game number 54.

Figure 8:
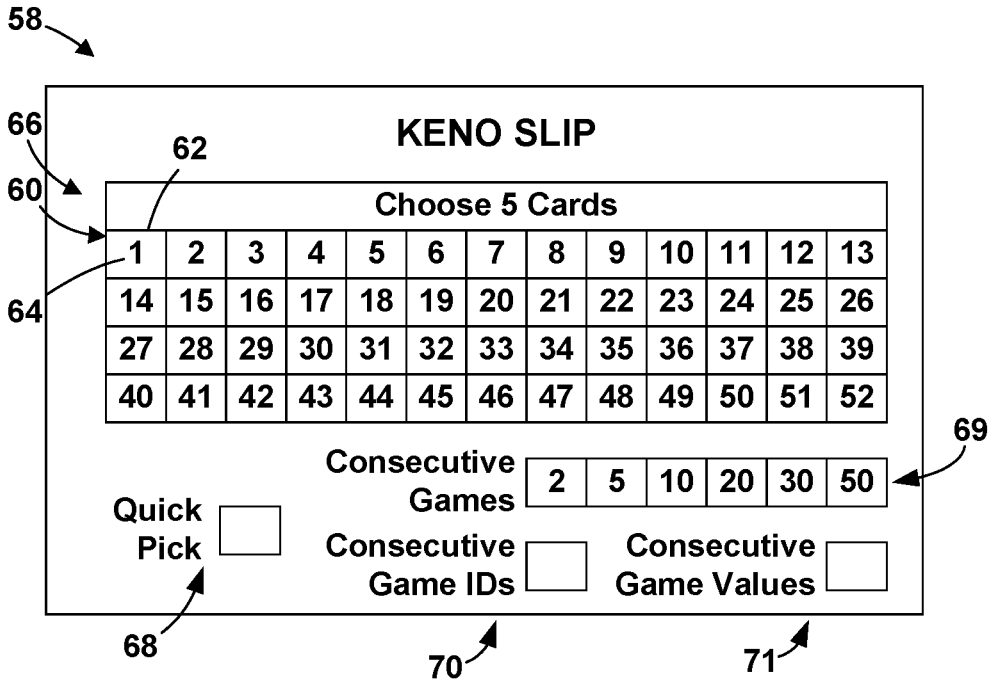
FIG. 8 shows an example paper slip for use with the game of FIGS. 6 and 7.
Figure 12:
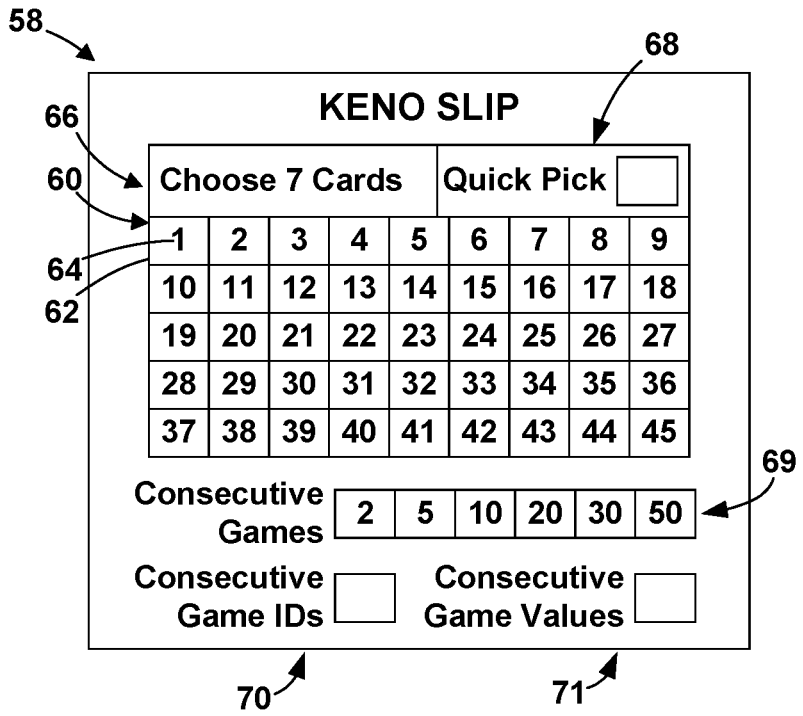
FIG. 12 shows an example paper slip for use with the game of FIGS. 9 and 11.
Figure 13:
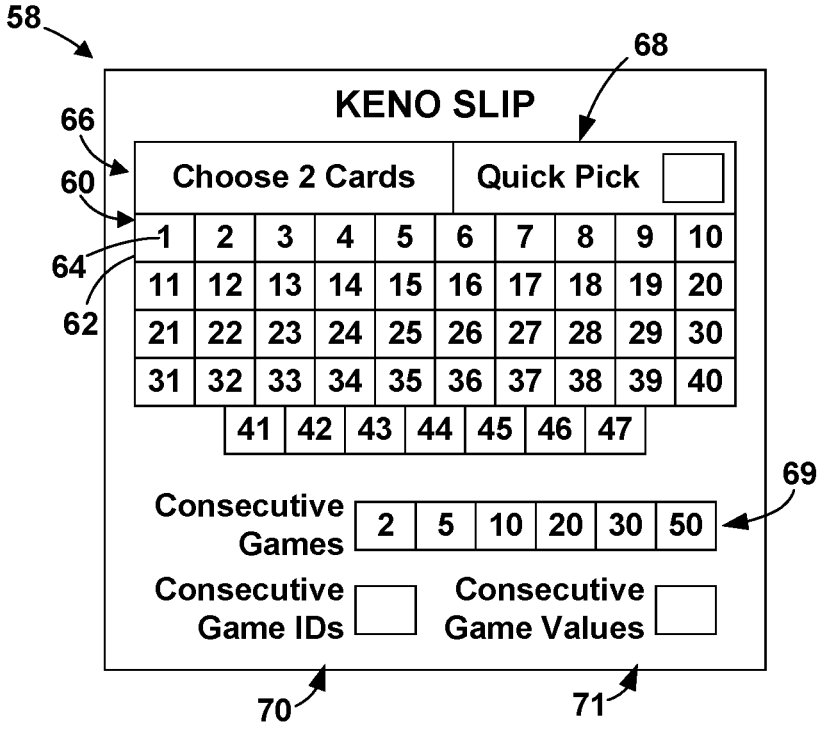
FIG. 13 shows an example paper slip for use with the game of FIG. 10.
Figure 15:
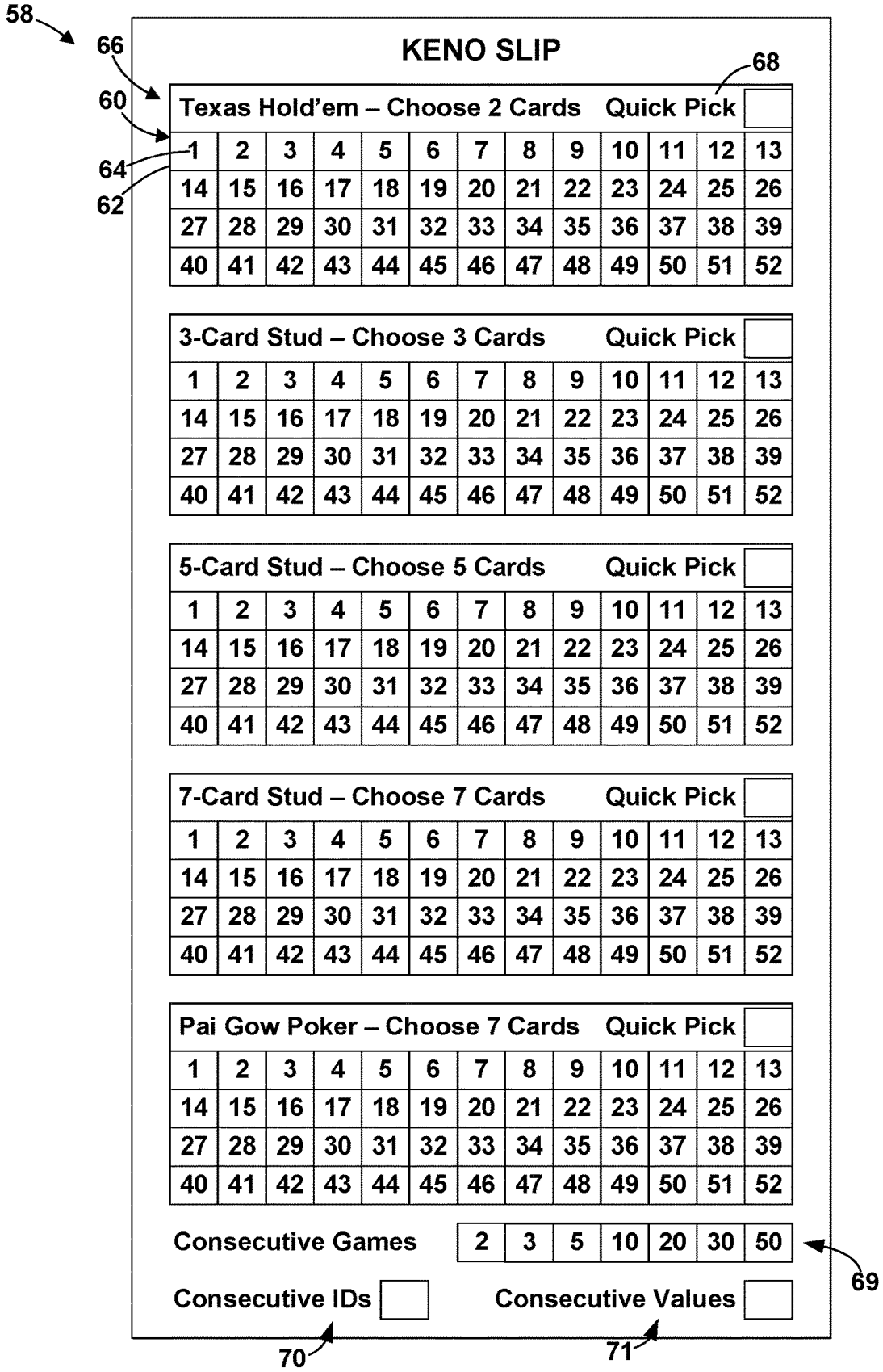
FIG. 15 shows an example paper slip for use with the game of FIG. 14.

In order to play the keno-type game, in one scenario, a player makes her ID and segment choices at the remote location 24 by marking a slip of paper. One example of such a slip 58 for use with the display of FIGS. 6 and 7 is shown in FIG. 8. One example of such a slip 58 for use with the display of FIGS. 9 and 11 is shown in FIG. 12. One example of such a slip 58 for use with the display of FIG. 10 is shown in FIG. 13. One example of such a slip 58 for use with the display of FIG. 14 is shown in FIG. 15. The slip 58 has a choosing grid 60 for each game segment 66 that can be played where each ID available to be chosen is represented by a grid location 62. There will be the same number of grid locations 62 as there are on the display 24. Each grid location 62 is denoted by a unique ID 64 taken from the same set of unique IDs 34 used on the display 28. Optionally, the slip 58 may allow the player to choose a quick pick, as at 68, where the computer selects IDs for the player hands.

Optionally, the slip 58 allows the player to choose to play more than one game consecutively, as at 69, using the choices on the slip 58. The player marks the appropriate box for number of consecutive game he wishes to play. The player also has the option of playing either the same IDs for the consecutive games, as at 70, or the same values for the consecutive games, as at 71, or both. Choosing to play consecutive values 71 means that the randomly-selected values for the chosen IDs for first of the consecutive games are used for the remainder of the consecutive games. If neither IDs nor values are chosen, either IDs or values can be assumed. The present invention also contemplates that the player is not given a choice between IDs and values, but that the rules assume one or the other.

The player chooses IDs and segments by marking grid locations 62 in the choosing grids 60 associated with the corresponding segments that player wants to play. In the example marked slip 72 of FIG. 16, the player has chosen to play Texas Hold'em, 5-Card Stud, and 7-Card Stud. For Texas Hold'em and 7-Card Stud, the player put X's in the grid locations 62 of the chosen IDs, as at 74. For 5-Card Stud, the player put an X in the quick pick 68, as at 76. The player has chosen to play the same values for the next 30 games, as at 78, 79.

Figure 16:
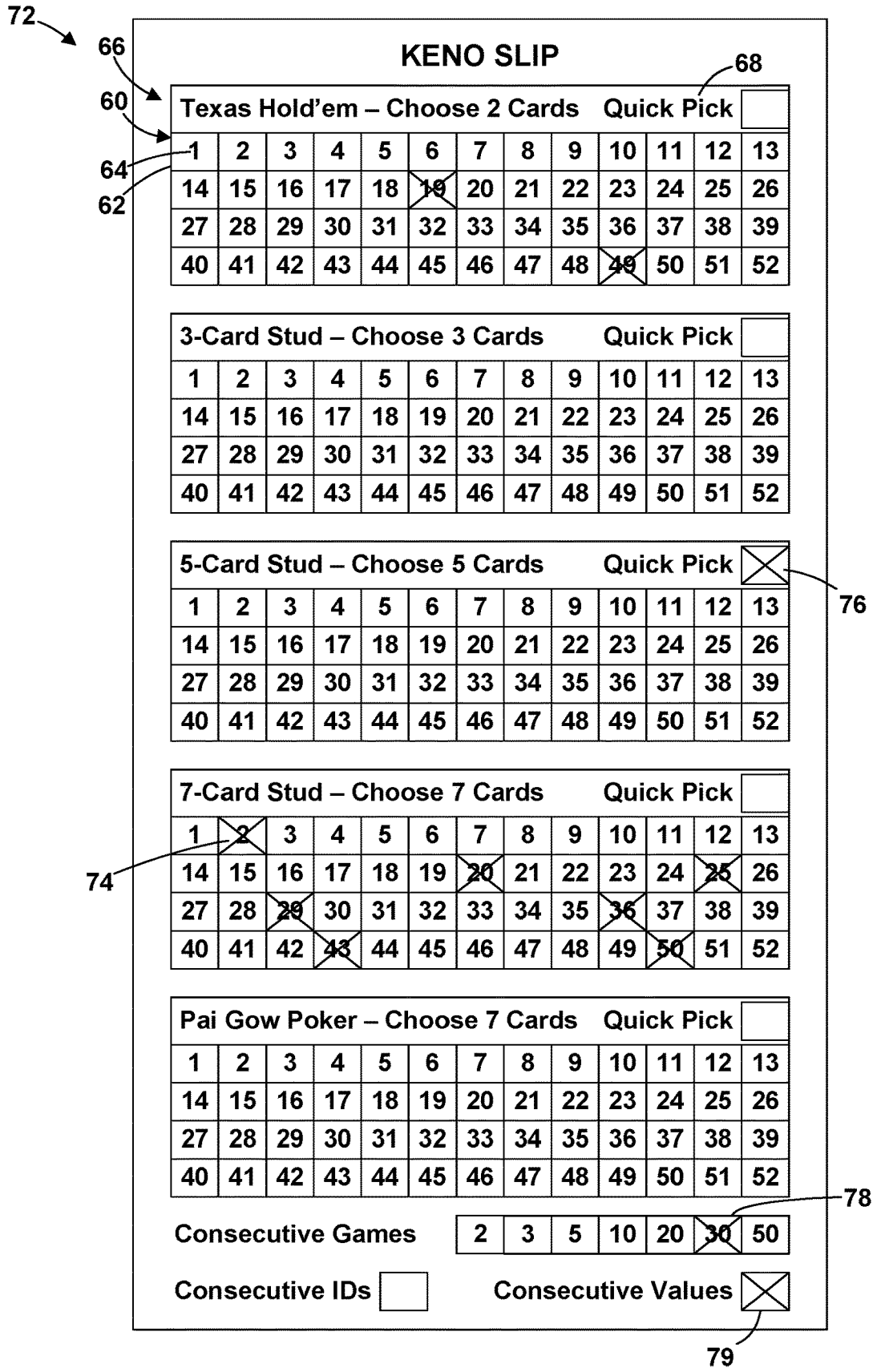
FIG. 16 shows the paper slip of FIG. 15 after the player has marked it with choices.

The marked slip 72 is given to a clerk with the appropriate amount for the wager. The wager can be a fixed amount for each segment. For example, if the wager is $1 per segment, the wager for the example of FIG. 16 is $3. Alternatively, there can be different wager amounts for each segment. Alternatively, the player can be allowed to choose the wager amount for each segment.

The clerk scans the marked slip 72 into a terminal 26 that sends the choices to a central location 22.

Alternatively, the player chooses IDs and segments on a terminal by, for example, a touch screen, keyboard, keypad, etc. The present invention contemplates that any way of choosing IDs may be used.

Figure 17:
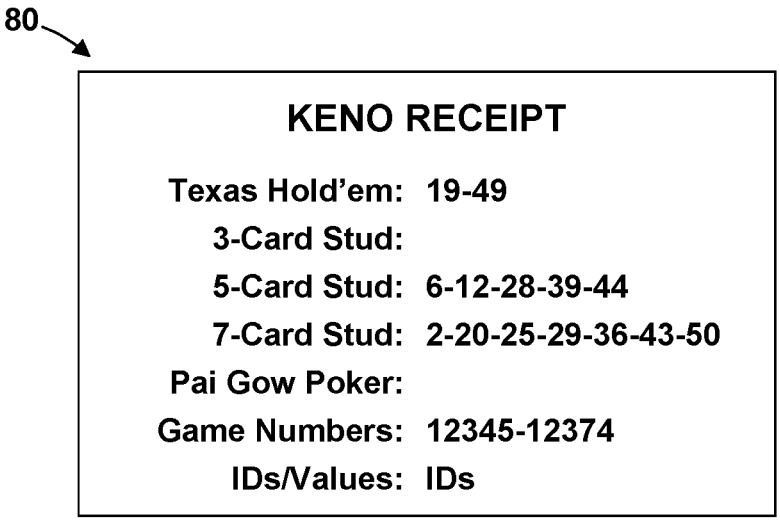
FIG. 17 shows a receipt for the marked paper slip of FIG. 16.

The player receives a receipt 80, such as a paper receipt or virtual receipt, indicating the IDs chosen by the player for each segment, the IDs selected by the computer for the quick picks, the numbers of the consecutive games being played, and whether IDs and/or values are being played consecutively, as shown in FIG. 17.

Figure 18:
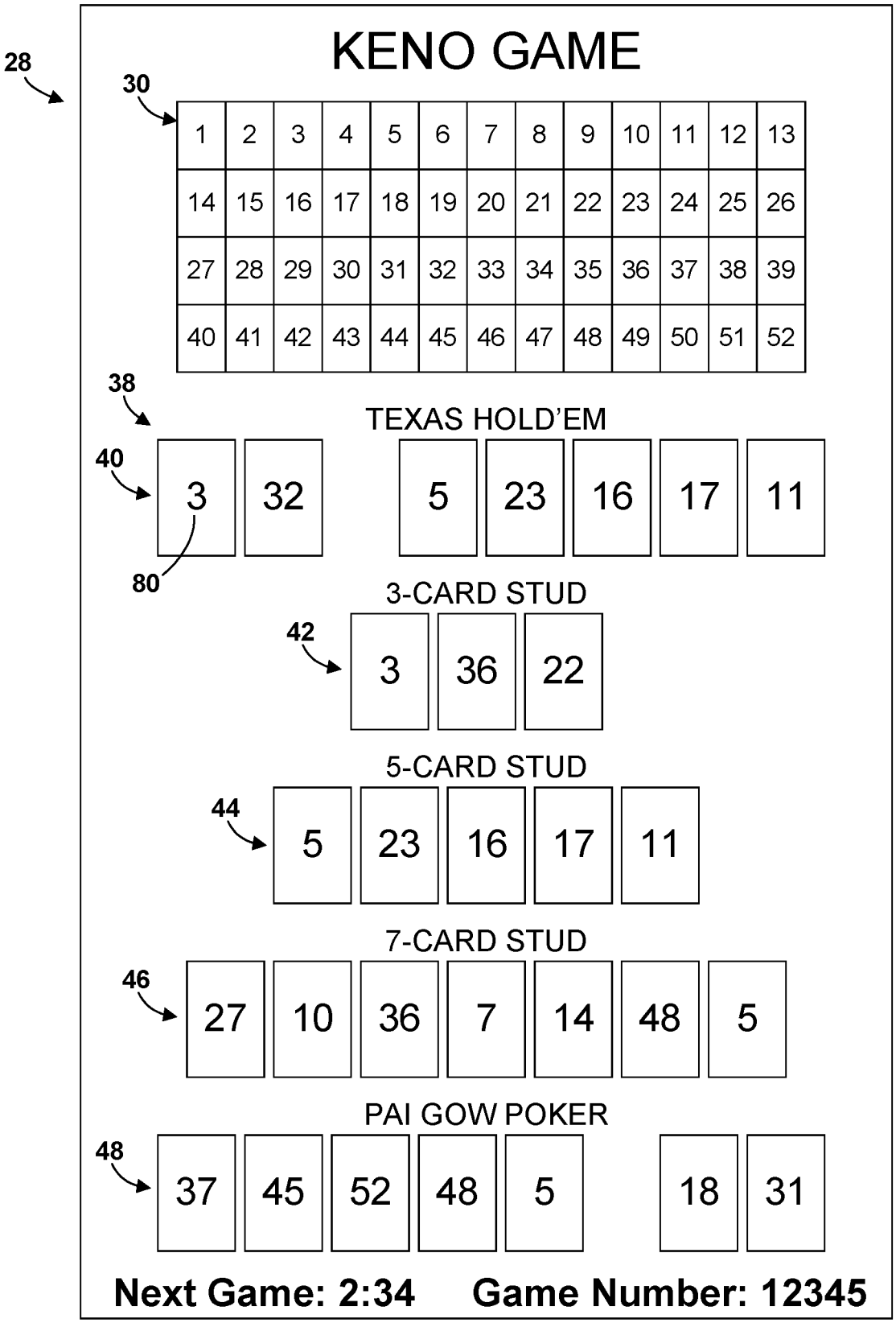
FIG. 18 shows the display of FIG. 14 after ID selections have been made.

At the appropriate time, the randomly-selected IDs 82 for the opponent hands 38 are revealed for the opponent embodiment, as in FIG. 18. For both embodiments, randomly-selected card values 84 are revealed on the playing grid 30, as in FIG. 19, from information received from the computer at the central location 22. The card values 84 may be displayed one at a time, all at once, or in subset combinations. They can be revealed sequentially by location, such as 1, 2, 3, 4, etc., or randomly by location.

At the appropriate time, for the opponent embodiment, the values corresponding to the selected opponent hand IDs are also revealed. The opponent hand IDs 82 are either kept on the display 28, as in FIG. 19, or removed. Optionally, revealing the opponent hand IDs 82, as in FIG. 18, is skipped and the card values 84 are immediately shown.

For the opponent embodiment, after the opponent hands 38 and card values 84 are revealed, the player determines her hand by combining the card values 84 associated with her chosen IDs. If the player chose to play consecutive games with the same values, as in the ticket of FIG. 16, the player hands are comprised of the values 84 associated with her chosen IDs from the first game of the consecutive games. Then the player compares each of her hands to that of the corresponding opponent hand 38. If the player hand has a higher rank than the corresponding opponent hand 38, the player is a winner and is paid the appropriate amount. In the continuing example of FIG. 19, the player Texas Hold'em hand is Q♠ and 6♦, the opponent Texas Hold'em hand is J♦ and 6♥, and the community cards, taken from the 5-Card Stud hand, are K♣, 4♠, J♣, 4♥, and 4♣. So the opponent wins with a full house, 4's over J's. The player 5-Card Stud hand is Q♦, 5♦, K♦, 2♦, A♦ and the opponent 5-Card Stud hand is K♣, 4♠, J♣, 4♥, and 4♣. So the player wins with a flush. The player 7-Card Stud hand is 9♠, 9♥, 7♣, 4♦, J♥, 6♣, and 9♣ and the opponent 7-Card Stud hand is 6♠, 7♦, 6♥, 3♠, A♣, A♠, and K♣. So the player wins with three-of-a-kind.

For the pay table embodiment, after the card values 84 are revealed, the player compares each of her hands comprised of the card values 84 associated with her chosen IDs to the corresponding pay table 36. If the player hand is in the pay table 36, the player is paid the corresponding amount shown in the pay table 36.

The above-described keno-type system is but one form of a keno-type system. In another form, the player is provided with an individual terminal, such as a hand-held terminal, tablet, mobile phone, a floor terminal, or a kiosk, from which she can make ID and segment choices. In yet another form of system, the player plays via a personal computer off-line or on a network such as the Internet, or via a mobile telephone, PDA, or tablet. The present invention contemplates that the keno form can be played completely on any electronic device, meaning that the player can make all choices and view all result on a single device.

Figure 20:
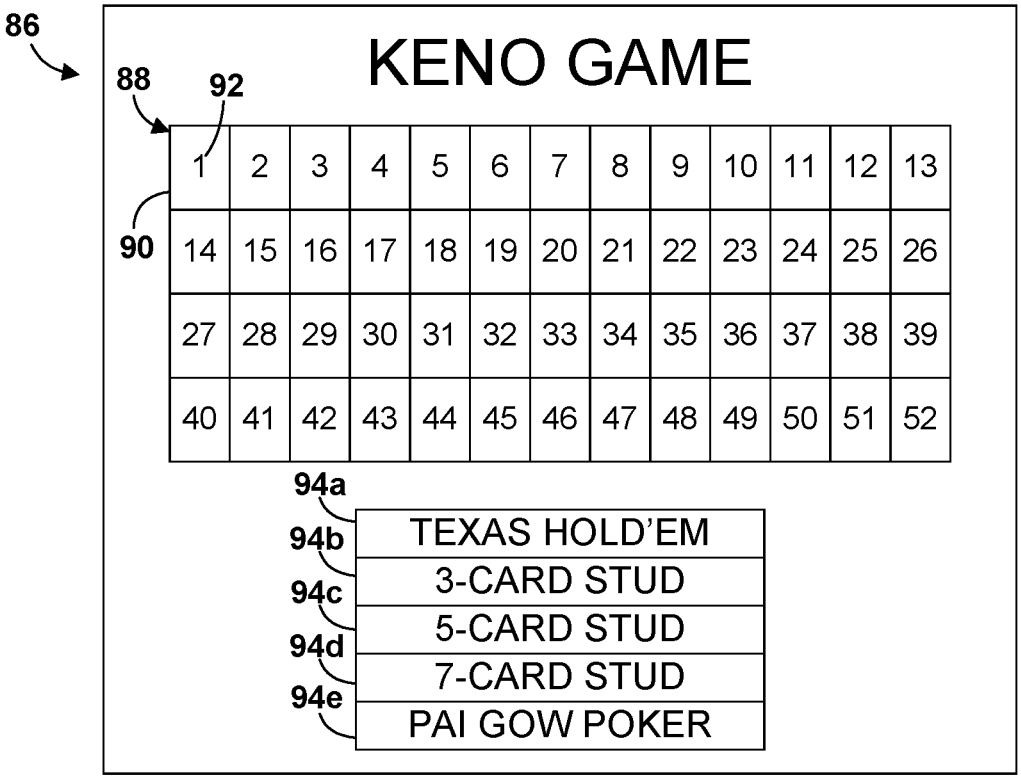
FIG. 20 shows an implementation of an individual terminal for choosing IDs.

There are a number of ways that an individual terminal can be implemented. In one implementation, shown in FIG. 20, the terminal 86 has one choosing grid 88 with locations 90 for the IDs 92 and a set of buttons 94*a-e* for the segments that the player is choosing for. The player chooses IDs 92 by using the corresponding grid locations 90 and then a button 94*a-e* for the segment the choices are for. For example, the player chooses five IDs then the Five-Card Stud button 94*c*, and then the player chooses two IDs then the Texas Hold'em button 94*a*. Alternatively, the player chooses the segment first and then chooses the IDs for that segment. If the player chooses the wrong number of IDs for the selected segment, the player may be notified. Optionally, the player is allowed to choose how many consecutive games will be played with these choices and whether the IDs and/or the values are played consecutively.

Figure 21:
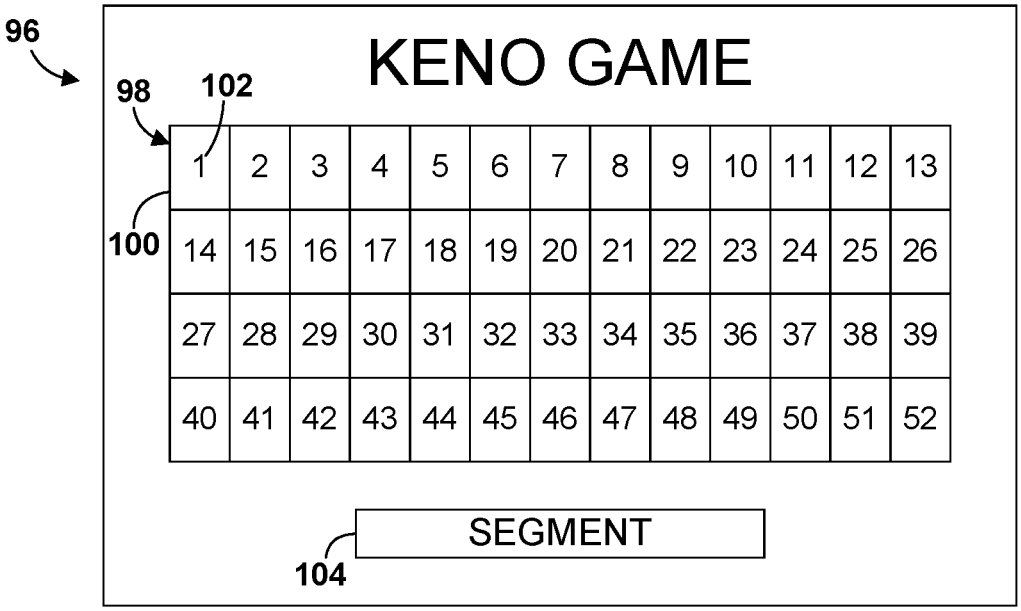
FIG. 21 shows another implementation of an individual terminal for choosing IDs.

In another implementation, the terminal 96 has one choosing grid 98 with grid locations 100 for the IDs 102 and one segment button 104, as in FIG. 21. The player chooses the appropriate number of IDs 102 for the desired segment and presses the segment button 104. The computer determines which segment the chosen cards are for by the number of IDs 102 chosen.

In another implementation, the terminal has a choosing grid for each segment, much like the slip 60 of FIG. 15. After all the IDs are chosen, the player presses a button to continue play.

In another implementation, the player chooses IDs from a displayed list of available IDs rather than from a grid. In another implementation, no grid or list is displayed, but the player chooses using another medium, for example, a keyboard with a key for each available ID or a keypad with the numerals 0-9. In another implementation, the player can choose a "quick pick," where the player does not herself choose the individual IDs, but instructs the computer to randomly select the IDs for the player hands.

The IDs chosen by the player may be displayed in some manner so that the player receives feedback as to which IDs are chosen. For example, the background of the chosen IDs is shown cross-hatched or in a different color. The cross-hatching or color can be different for different segments.

Optionally, the individual terminal also displays the game result, including the opponent hands and card values, so there is no need to watch a central monitor to play the game. A player can play the entire game using a computer, tablet computer, mobile phone, or any other device that is capable of displaying the game and accepting choices by the player.

Figure 22:
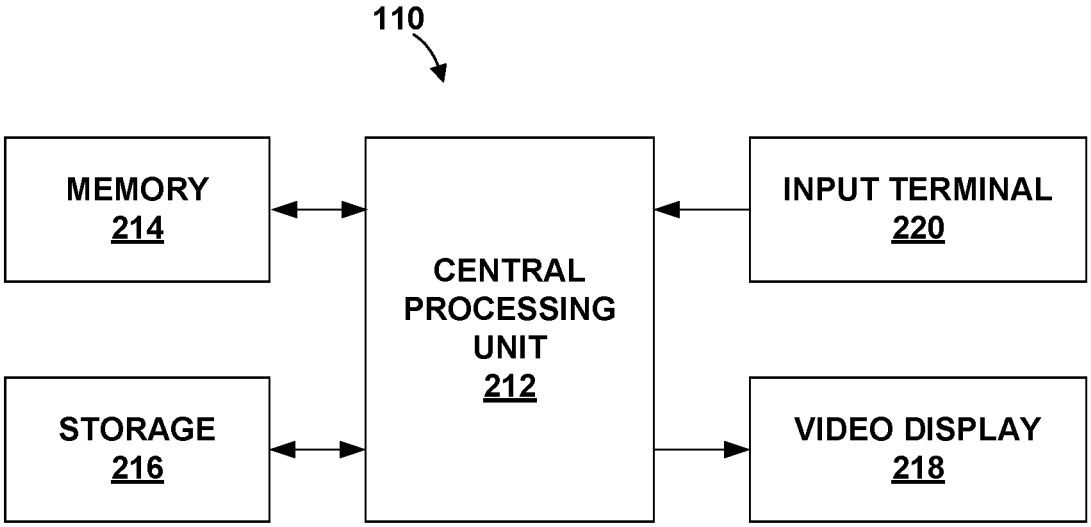
FIG. 22 is a block diagram of a stand-alone machine.

A block diagram of a stand-alone machine 110 is shown in FIG. 22. There is a central processor 212, memory 214, storage 216, a video display 218, and an input device 220. The central processor 212 runs a program in memory 214 and storage 216. The progress of the game is shown on the video display 218 and the player choices and wagers are received by the input device 220. All elements of the game may be shown on one display 218. Alternatively, some elements of the game may be shown on one display while other element are shown on another display. Alternatively, a single display may alternate between displaying different elements of the game.

Figure 23:
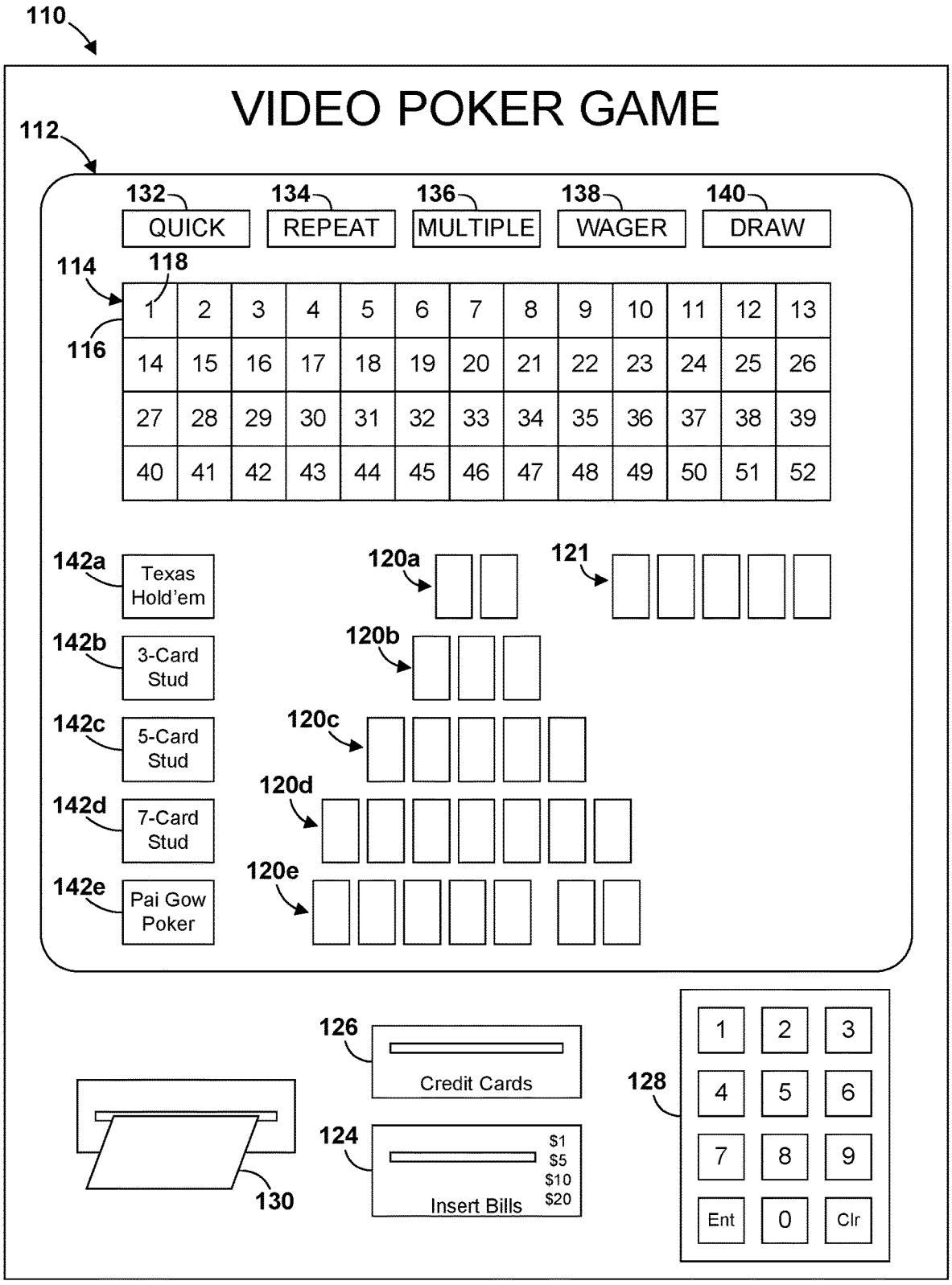
FIG. 23 shows a display implementing a video poker-type embodiment of the pay table embodiment of the game of the present invention.
Figure 24:
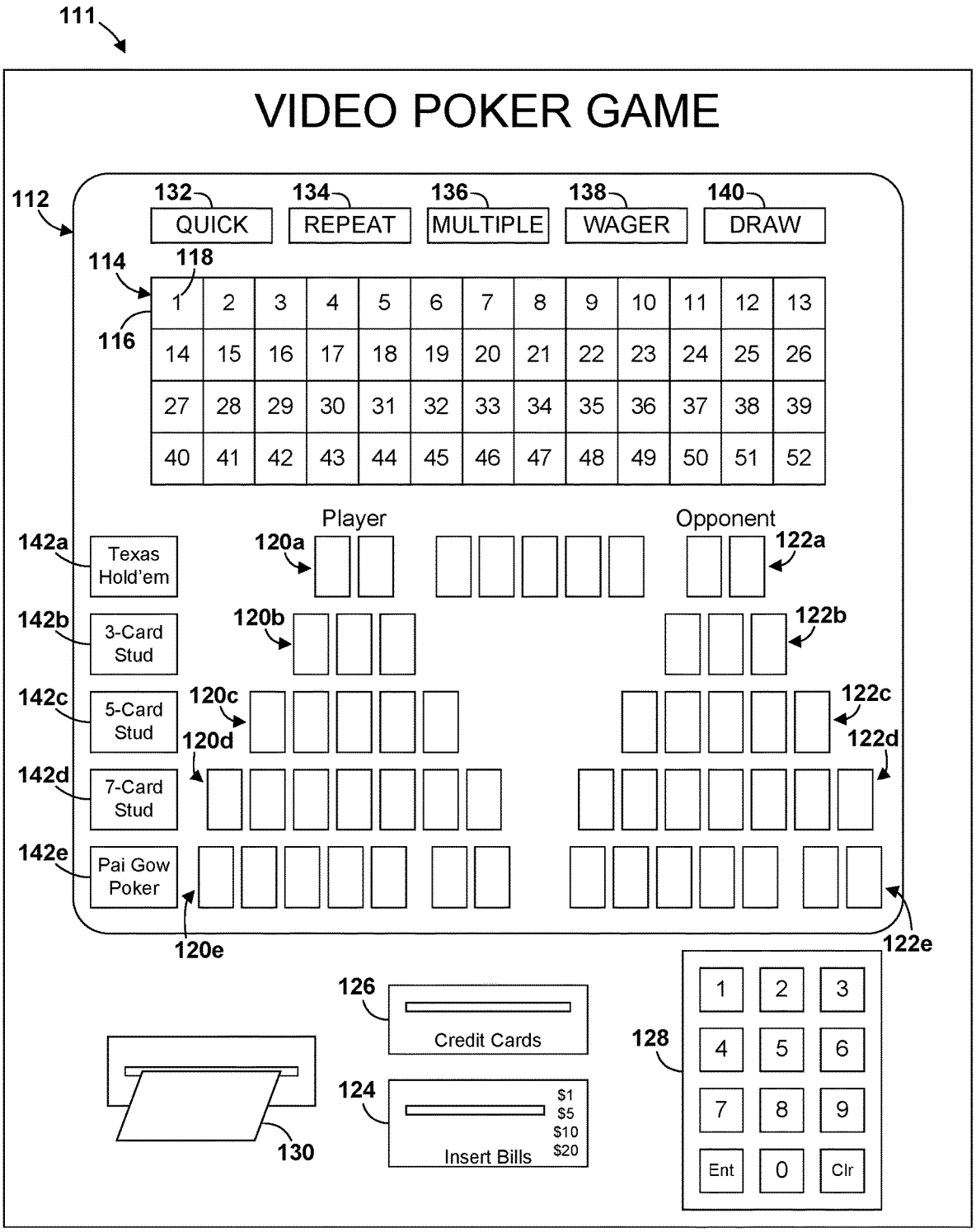
FIG. 24 shows a display implementing a video poker-type embodiment of the opponent embodiment of the game of the present invention.

An example display of a standalone machine 110 for the pay table embodiment is shown in FIG. 23 and an example display of a standalone machine 111 for the opponent embodiment is shown in FIG. 24. Each player has her own machine and plays at her own pace. An example is a video machine at a gaming establishment. The choosing grid 114 of locations 116 with IDs 118, the player hands 120*a-e*, and for the opponent embodiment, the opponent hands 122*a-e* are displayed on the video screen 112. If the pay table embodiment includes a Texas Hold'em segment, the community cards 121 are shown, as in FIG. 23.

Prior to playing any game, the player inserts cash into a money reader 124, tokens into a slot, swipes a credit card, debit card, player card, or ticket such as TITO in a card reader 126, or otherwise inputs monetary value into the machine 110. Typically, credits are used to keep track of the amount of value the player has in the machine 110. Any way of keeping track of the player's account is contemplated.

Figure 25:
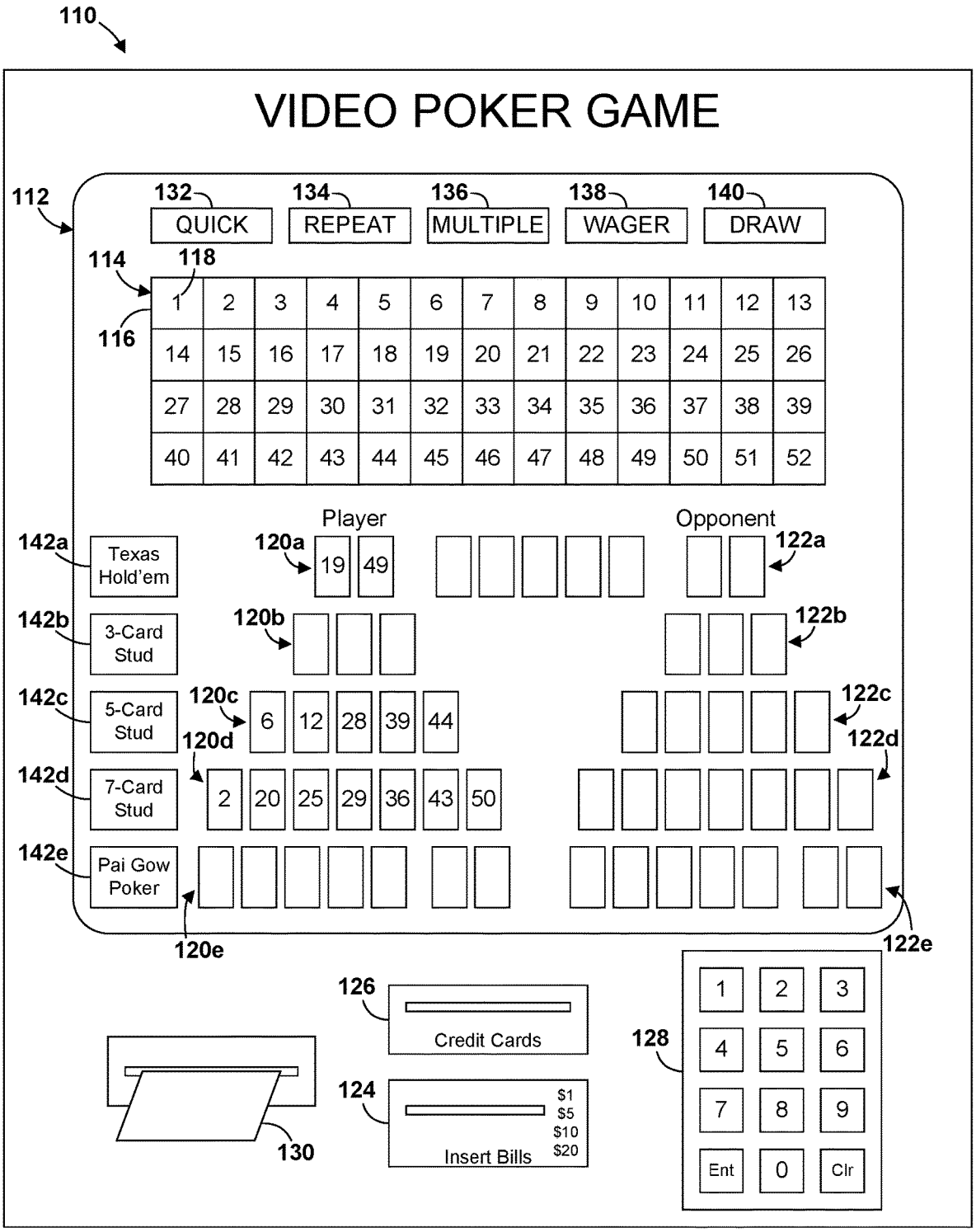
FIG. 25 shows a display of FIG. 24 with the chosen player hands.

The player begins a game by choosing segments and IDs. IDs choices for the desired segments are entered by pressing the appropriate segment button 142*a-e* and entering ID choices on the choosing grid 114. As choices are made, they are shown in the player hand locations 120*a-e*, as in FIG. 25. Optionally, the machine 110 may include a QUICK button 132 to provide the player with a "quick pick" option, a REPEAT button 134 so that the player may repeat the ID and segment choices from the previous game, and/or a MULTIPLE button 136 where the player can choose the number of consecutive games to play with the current segment choices and either ID choices and/or values. The number of games is chosen using either the keypad 128 or the choosing grid 114. To use the choosing grid 114, the player presses the grid location 116 corresponding to the number of consecutive games, for example, the "10" location for a 10 consecutive games. For the ID/value choice, a set of buttons may be displayed, where the player presses the appropriate button to choose to either repeat the ID choices, the values randomly selected for those ID choices from the first of the consecutive games, or, optionally, both.

After the IDs and segments are chosen, the player presses the WAGER button 138 and indicates the amount to wager for the game using either the keypad 128 or the choosing grid 114. Alternatively, rather than make one wager, the player can wager on each segment independently by setting the wager amount after the grid locations 116 for each segment are chosen or by using the segment buttons 142*a-e* after the WAGER button 138. The amount the player can wager depends on the rules of the establishment.

After the wagers are made, the player presses the DRAW button 140 to complete the game.

Figure 26:
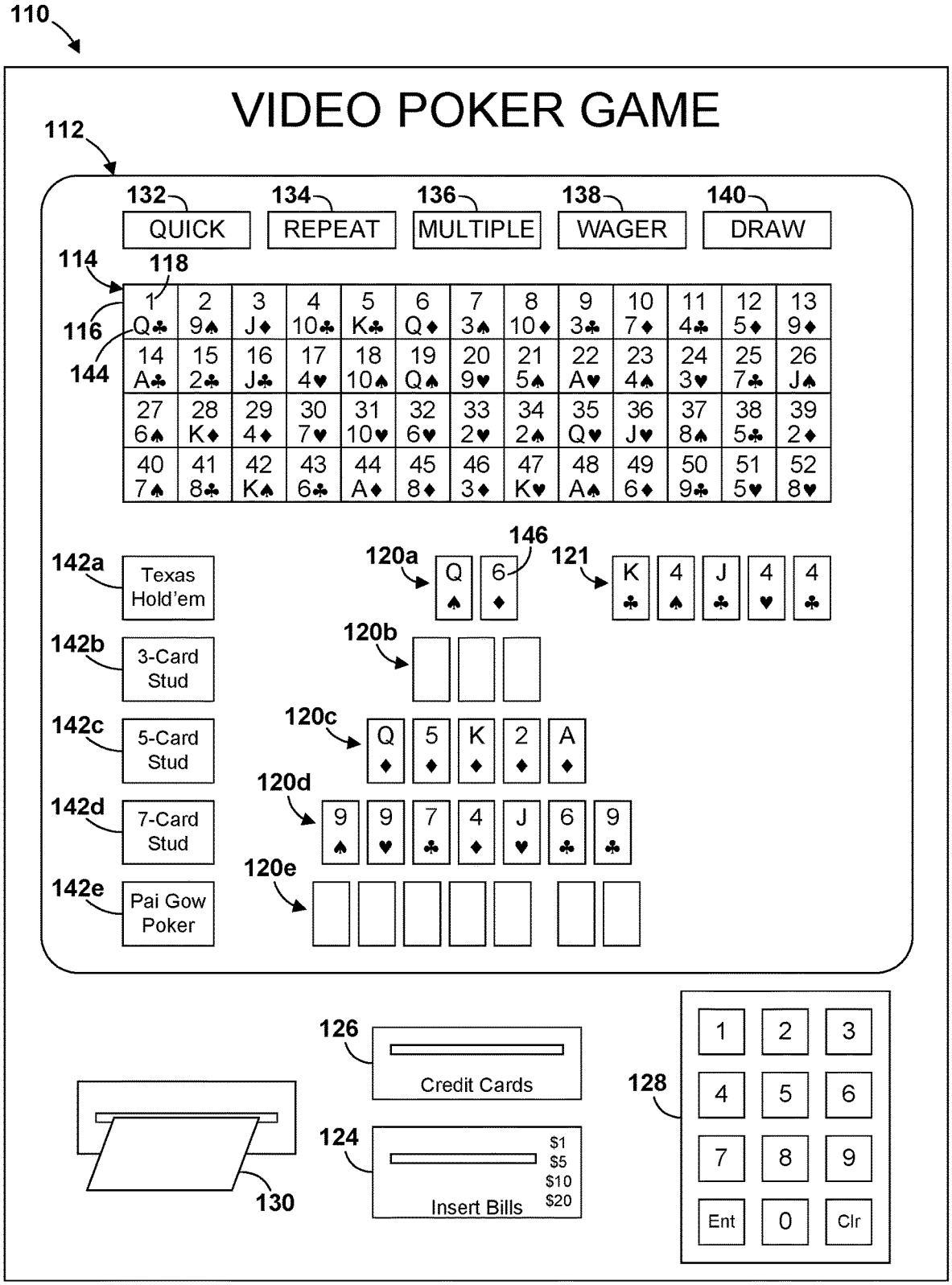
FIG. 26 shows a display of FIG. 23 with card values revealed.

For the pay table embodiment, the computer randomly selects IDs for the card values for the IDs, and then reveals them in the grid 114, as at 144, and in the player hand locations 120*a-e*, as at 146, as in FIG. 26. The player hands are compared to the corresponding pay table and any winning amounts are credited to the player on the machine.

Figure 27:
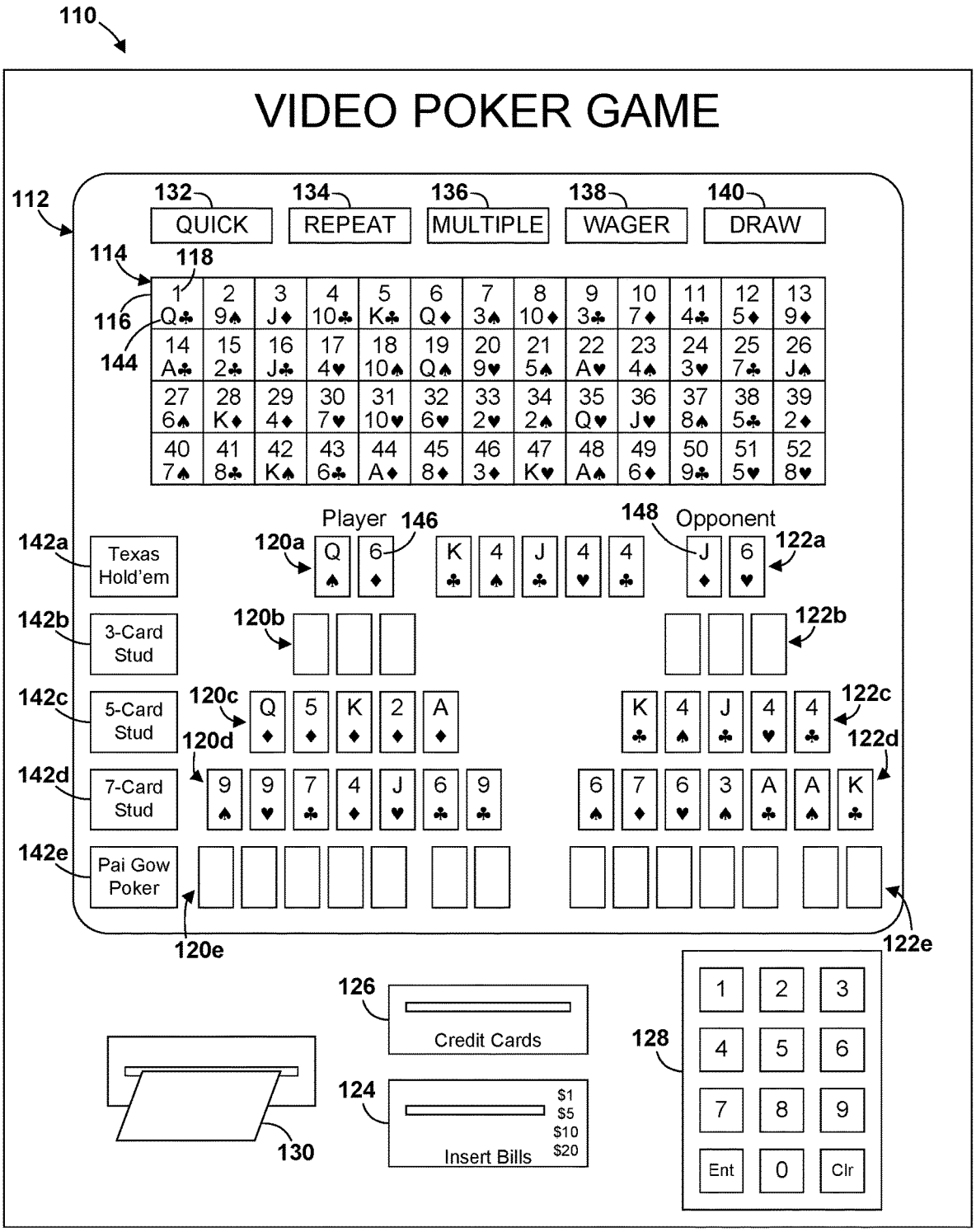
FIG. 27 shows a display of FIG. 24 with card values revealed.

For the opponent embodiment, the computer randomly selects IDs for the opponent hands and card values for the IDs, and then reveals them in the grid 114, as at 144, in the player hand locations 120*a-e*, as at 146, and in the opponent hand locations 122*a-e*, as at 148, as in FIG. 27. If the player chose to play consecutive games with the values, the values in the player hand locations 120*a-e* remain the same as the previous game.

Corresponding player and opponent hands are compared and any winning amounts are credited to the player on the machine. Any credits the player has on the machine may be printed on a voucher 130 for payment by a cashier, they may be paid in cash or by other methods by the terminal 110, or transferred to the player's account.

Figure 28:
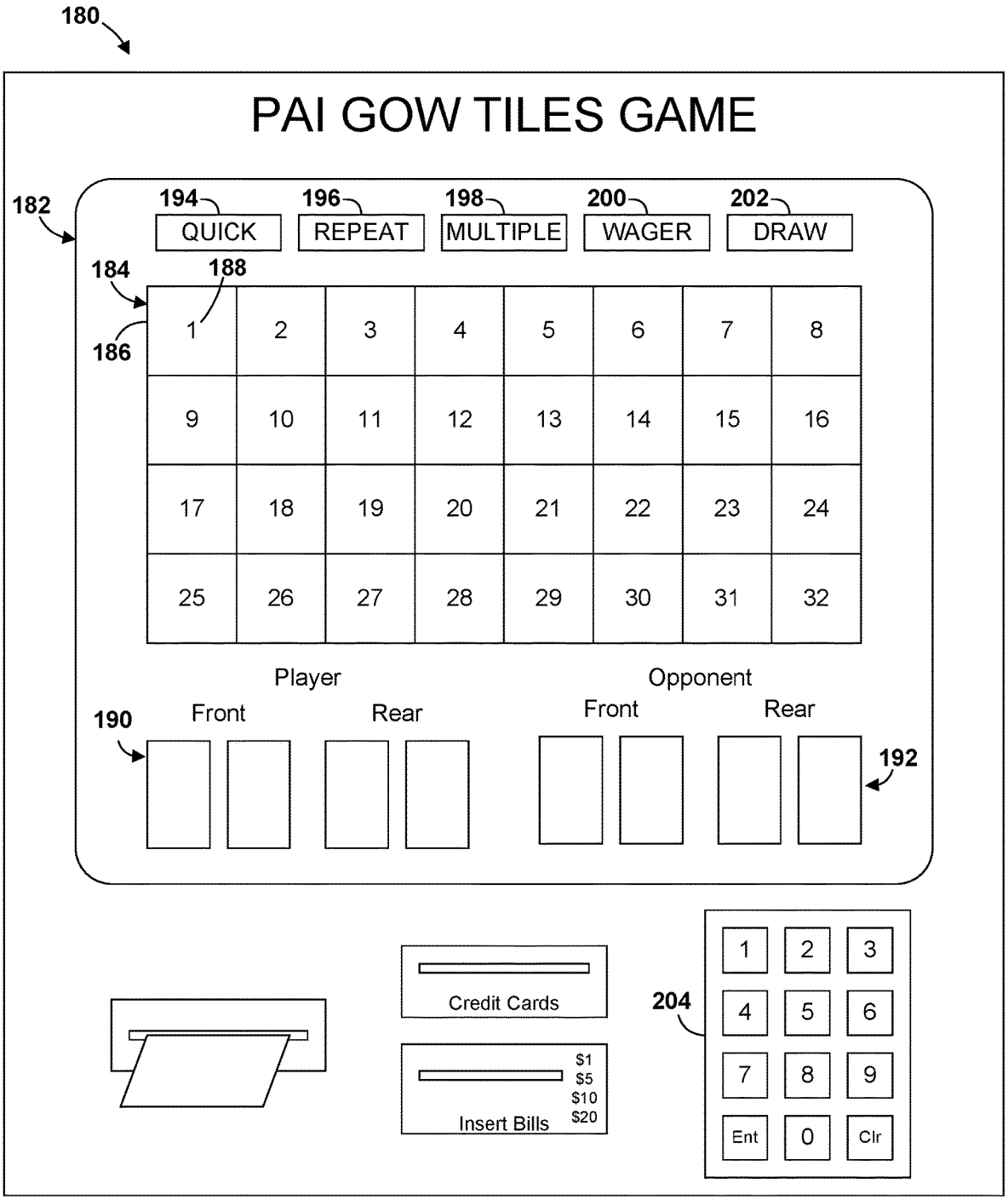
FIG. 28 shows a display implementing a video Pai Gow tiles embodiment of the game of the present invention.

An example of a standalone machine 180 implementing Pai Gow tiles for the opponent embodiment is shown in FIG. 28. The choosing grid 184 of locations 186 with IDs 188, the player hand 190, and the opponent hand 192 are displayed on the video screen 182. Prior to playing any game, the player inputs monetary value into the machine 180.

The player begins a game by choosing IDs for the player hand. ID choices are entered by pressing the locations 186 on the choosing grid 184 corresponding to the desired IDs 188. As choices are made, they are shown in the player hand location 190. Optionally, the machine 180 may include a QUICK button 194 to provide the player with a "quick pick" option, a REPEAT button 196 so that the player may repeat the ID choices from the previous game, and/or a MULTIPLE button 198 where the player chooses the number of consecutive games to play with the current ID choices or tile values. The number of consecutive games is chosen using either the keypad 204 or the choosing grid 184, as described above. For the ID/value choice, a set of buttons may be displayed for the player to make the choice, as described above.

After the IDs are chosen, the player presses the WAGER button 200 and indicates the amount to wager for the game using either the keypad 204 or the choosing grid 184.

After the wagers are made, the player presses the DRAW button 202 to complete the game. The computer selects IDs for the opponent hands and the tile values for IDs, and then reveals them in the grid 184 and in the opponent hand location 192. The computer arranges the tiles into front and rear hands as appropriate for the rules of the game. If the player chose to play consecutive games with the values, the values in the player hand location 190 remain the same as the previous game. The player and opponent hands are compared and any winning amounts are credited to the player on the machine 180.

Alternatively, the standalone machine may be a personal computer on a network. Wagers can be made by debits to credit cards, debit cards, bank accounts, or other value equivalents, and payouts may be made by crediting credit cards, debit cards, or other bank accounts.

There are two basic types of scratch and pull-tab tickets, traditional tickets and probability tickets, either of which can be implemented as paper or video tickets. In a traditional ticket, the ticket is determined to be a winning or losing ticket when it is printed, not when it is played. With these tickets, a player scratches off the entire ticket. The large majority of state lottery scratch tickets are of the traditional type. Since it known when the tickets are printed how many are winning tickets and the amount they will win, the total of payouts for the game (all of the tickets) is known prior to any ticket being played.

Probability tickets, on the other hand, are not predictable. With a probability ticket, the player chooses what part of the ticket to play. For example, if the ticket has five selections, the player chooses which one to play. If the selection chosen by the player is the best, the player wins. Otherwise the player loses. Consequently, a probability ticket is determined to be a winner or loser when the ticket is played, not when it is printed.

Examples of probability tickets 150 for the pay table embodiment of the present invention are shown in FIGS. 29 and 30, where FIG. 29 shows a 7-card stud game and FIG. 30 shows a Texas Hold'em game. The ticket 150 is printed with a covered grid 152 of 52 locations 154, where the random selection of values for each location 154 is made prior to printing. The player wagers by paying for and receiving the ticket 150. The player makes her choices by scratching the appropriate number of grid locations 154, and comparing the hand resulting from the card values revealed at the chosen grid locations to the pay table 158.

Figure 31:
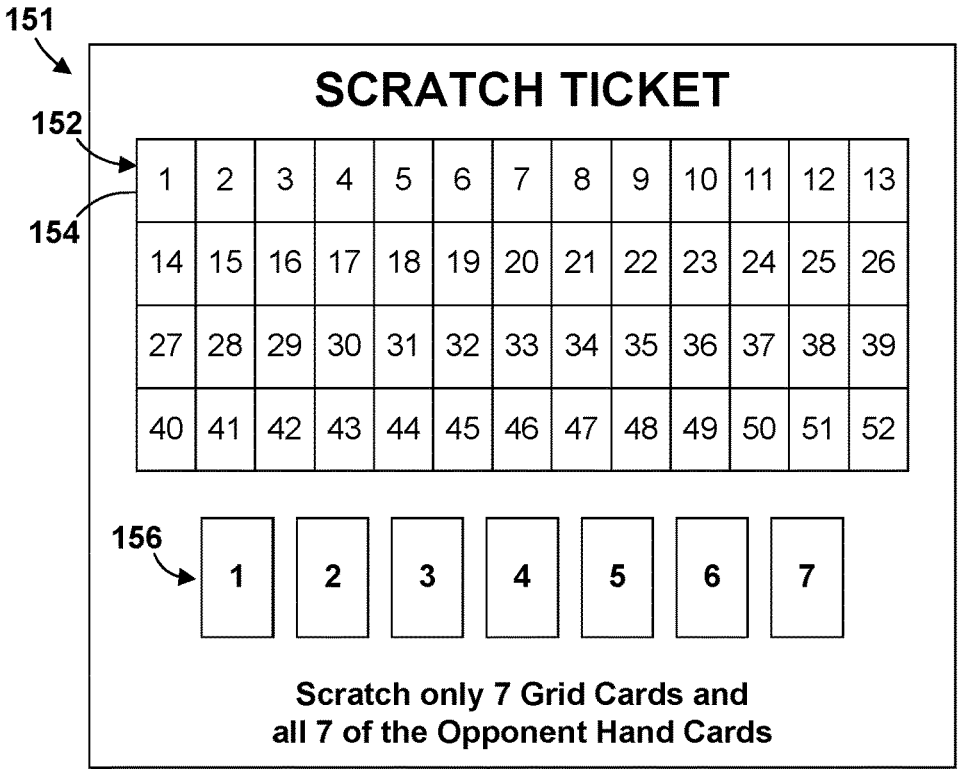
FIG. 31 shows a probability scratch ticket implementing the opponent embodiment of the game of the present invention.
Figure 32:
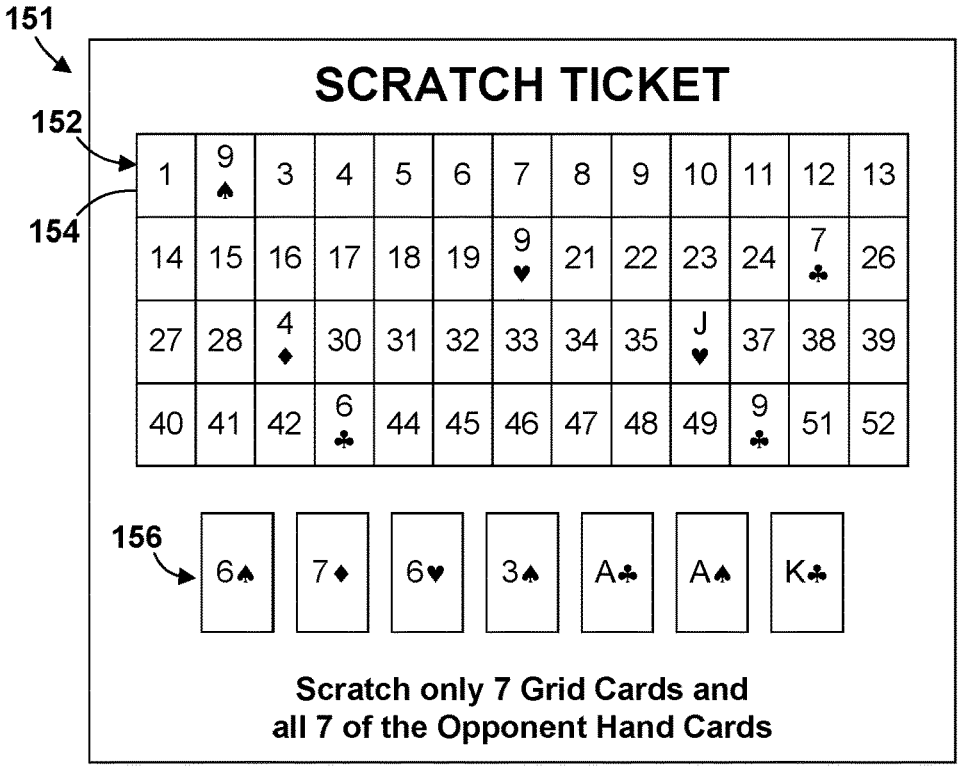
FIG. 32 shows a ticket of FIG. 31 with the chosen cards and the opponent hand revealed.

An example of a probability ticket 151 for the opponent embodiment of the present invention is shown in FIG. 31. The ticket 151 is printed with a covered grid 152 of 52 locations 154 and an opponent hand 156, where the random selection of values for each location 154 and the opponent hand 156 is made prior to printing. The player wagers by paying for and receiving the ticket 151. The player makes her choices by scratching the appropriate number of grid locations 154 and the opponent hand 156, as in FIG. 32, and comparing the hand resulting from the card values revealed at the chosen grid locations to the opponent hand 156.

Figure 33:
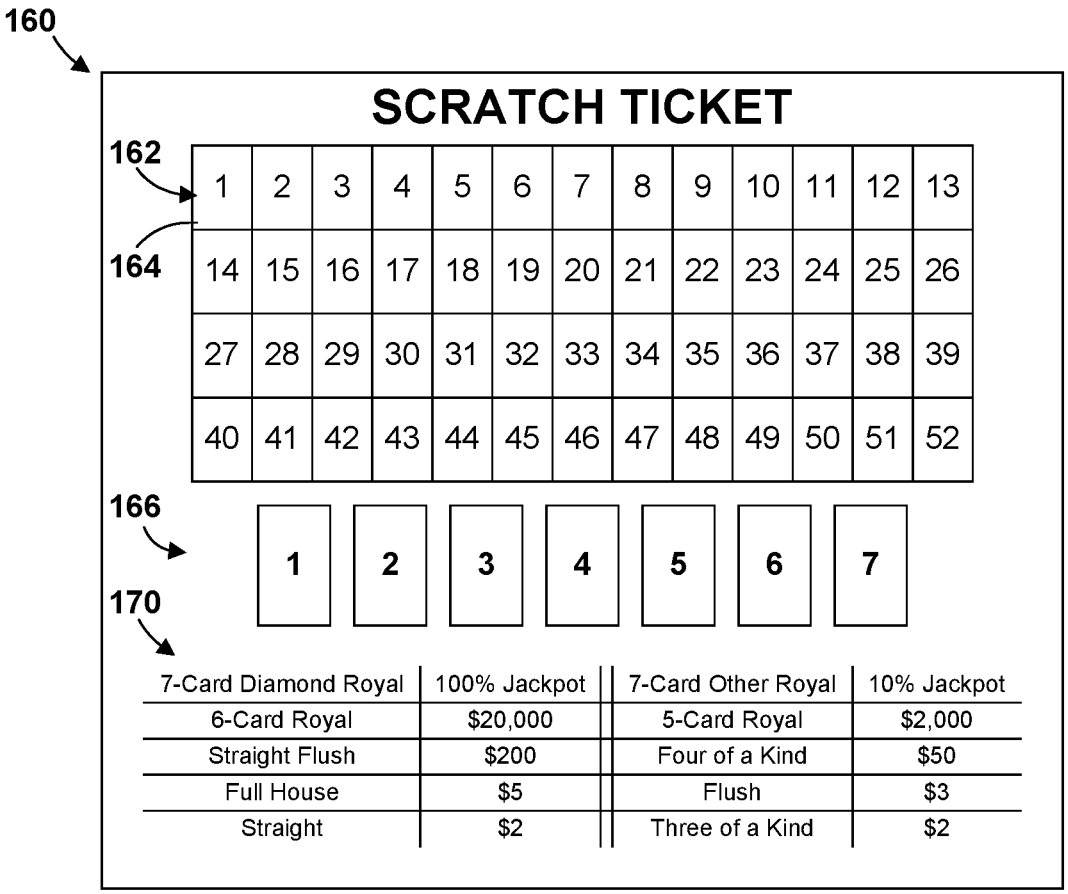
FIG. 33 shows a traditional scratch ticket implementing the pay table embodiment of the game of the present invention.

An example of a traditional ticket 160 of the pay table embodiment of the present invention is shown in FIG. 33. The ticket 160 is printed with a covered grid 162 of 52 locations 164 and a player hand 166. The selection of values for each location 164 and the selection of the IDs for the player hand 166 are made prior to printing. The player wagers by paying for and receiving the ticket 160. The player scratches all of the grid locations 164 and the player hand 166. The player compares the hand made from the values of the cards in the player hand 166 to the pay table 170.

Figure 34:
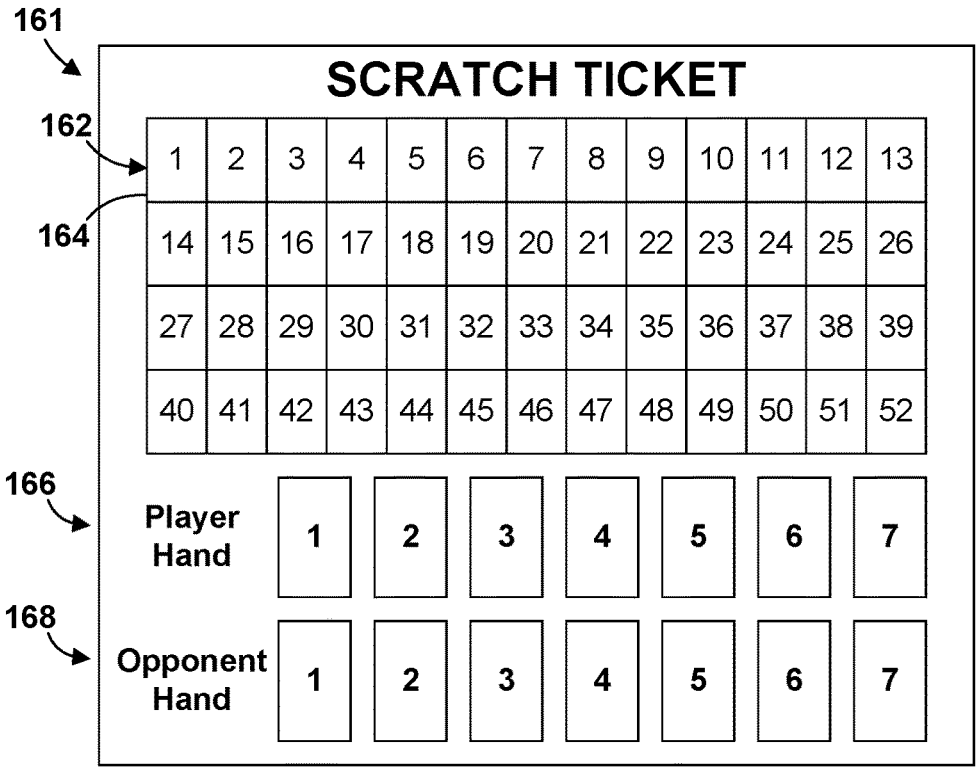
FIG. 34 shows a traditional scratch ticket implementing the opponent embodiment of the game of the present invention.
Figure 35:
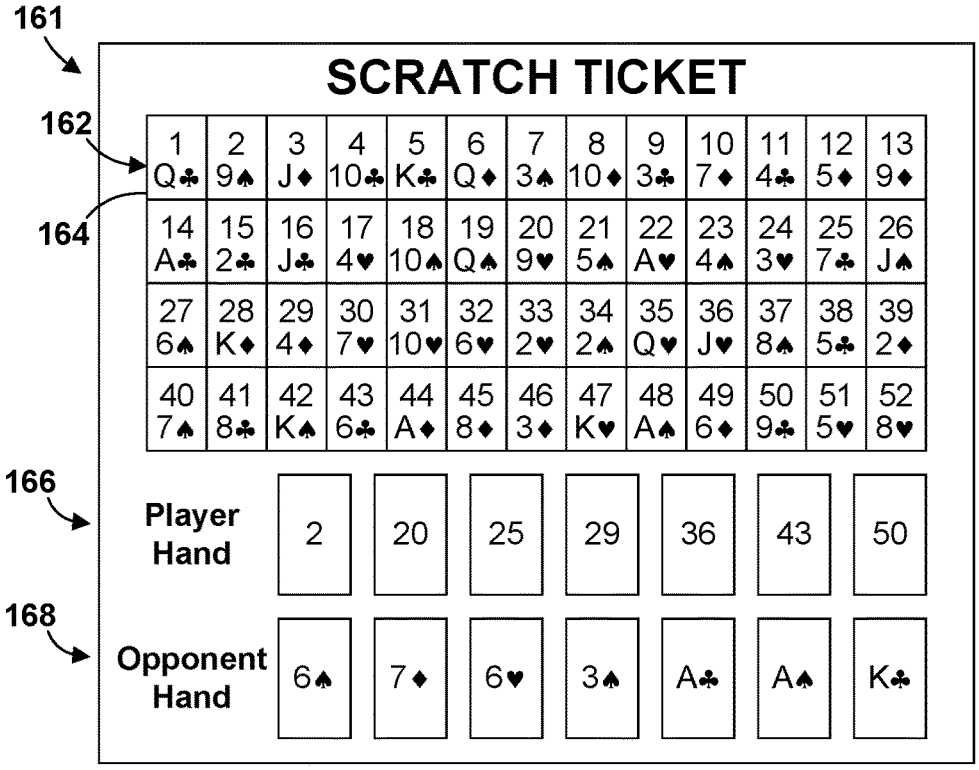
FIG. 35 shows a ticket of FIG. 34 with the grid, player hand, and opponent hand revealed.

An example of a traditional ticket 161 of the present invention is shown in FIG. 34. The ticket 161 is printed with a covered grid 162 of 52 locations 164, a player hand 166, and an opponent hand 168. The selection of values for each location 164 and the opponent hand 156 and the selection of the IDs for the player hand 166 are made prior to printing. The player wagers by paying for and receiving the ticket 161. The player scratches all of the grid locations 164, the player hand 166, and the opponent hand 168, as in FIG. 35. The player compares the hand made from the values of the cards in the player hand 166 to the opponent hand 168.

Thus it has been shown and described a method and apparatus for playing a card game. Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A system for playing consecutive games comprising:

(a) at least one video display;

(b) at least one input terminal;

(c) a central location operationally connected to and remotely located from the at least one video display and at least one input terminal and connected to carry out a game program, including receiving player choices and wagers from the at least one input terminal and generating an image on the at least one video display;

(d) the game program containing instructions for carrying out a game method performed by the system, the method comprising the steps of:

(1) providing a set of playing token values;

(2) providing a number of unique IDS;

(3) receiving from a player at least one chosen ID for a player hand and a number of consecutive games to play, the number being greater than one;

(4) for the first of the number of consecutive games: (i) randomly selecting at least one value from the set of values for an opponent hand as a first opponent hand rank; (ii) assigning randomly-selected values to the IDs; (iii) displaying the values assigned to the IDs on the video display; (iv) producing a player hand rank as a combination of the values assigned to the IDs in the player hand; (v) comparing the player hand rank to the first opponent hand rank; (vi) declaring the player a winner if the first player hand rank beats the first opponent hand rank;

(5) for the remainder of the number of consecutive games: (i) randomly selecting at least one value from the set of values for the opponent hand as a second opponent hand rank; (ii) comparing the player hand rank to the second opponent hand rank; and (iii) declaring the player a winner if the first player hand rank beats the second opponent hand rank.

2. The system of claim 1 wherein the number of playing token values is the same as the number unique IDs.

3. The system of claim 1 wherein the set of playing token values is a standard poker deck and the hand ranks are determined by standard poker rankings.

4. The system of claim 1 wherein the game further comprises a side bet wherein the player wins the side bet if a bonus hand comprised of a combination of one or more of the values assigned to the IDs in the player hand and one or more values in the opponent hand is found in a pay table.

5. The system of claim 1 wherein randomly selecting at least one value for the opponent hand as the opponent hand rank comprises (a) randomly selecting at least one ID for the opponent hand and (b) producing the opponent hand rank as the combination of the values assigned to the IDs in the opponent hand.

6. The system of claim 1 wherein the game has one or more game segments and each game segment has at least one player hand.

7. The system of claim 6 wherein the values assigned to IDs selected for a game segment are not available to be assigned to IDs available to be chosen by the player for another game segment.

8. The system of claim 6 wherein all of the IDs are available to be chosen by the player for all of the game segments.

9. The system of claim 1 wherein the game program further includes the steps of providing at least one community card, randomly assigning values to the at least one community card, including the at least one community card value in the player hand when determining the player hand rank, and including the at least one community card value in the opponent hand when determining the opponent hand rank.

* * * * *